US006504521B1

(12) United States Patent
Inoue et al.

(10) Patent No.: US 6,504,521 B1
(45) Date of Patent: Jan. 7, 2003

(54) METHOD OF DRIVING LIQUID CRYSTAL DISPLAY DEVICE

(75) Inventors: Naoto Inoue, Shiki-gun (JP); Tomohiko Yamamoto, Nara (JP); Keiichi Tanaka, Tenri (JP); Koji Fujiwara, Tenri (JP); Hideki Ichioka, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/411,704

(22) Filed: Oct. 1, 1999

(30) Foreign Application Priority Data

Oct. 5, 1998 (JP) ..... 10-282483
Aug. 26, 1999 (JP) ..... 11-240310

(51) Int. Cl.[7] ..... G09G 3/36
(52) U.S. Cl. ..... 345/89; 345/95; 345/100
(58) Field of Search ..... 345/87, 38, 50, 345/99, 100, 204, 205, 206, 214, 102, 88, 89, 90, 92, 93, 95, 96

(56) References Cited

U.S. PATENT DOCUMENTS 5,668,032 A * 9/1997 Holmberg et al. ..... 438/144

FOREIGN PATENT DOCUMENTS

JP 61-215590 * 9/1986

OTHER PUBLICATIONS

"Drive System for TFT–LCDs Using Digital Drivers Having Gray–Scale Interpolative Function", by Hisao Okada, *The Journal of the Institute of Image Information and Television Engineers*, vol. 51, No. 10, pp. 1768–1776, 1997). In Japanese with English translation of relevant passages.

* cited by examiner

*Primary Examiner*—Bipin Shalwala
*Assistant Examiner*—Mansour M. Said
(74) *Attorney, Agent, or Firm*—David G. Conlin; William J. Daley, Jr.; Edwards & Angell, LLP

(57) ABSTRACT

As a method of driving a liquid crystal display device, the average voltage of reference line drive voltages Vcom for AC-driving a liquid crystal is set higher than the average voltage of signal line drive voltage V0. Moreover, when displaying a plurality of gray scales, the respective voltages are set so that the average voltage of the signal line drive voltages is lowered with a decrease in a voltage difference to be applied to the liquid crystal as an absolute value. In a liquid crystal display device of an opposing signal line structure, a high-quality image display is achieved by compensating for the non-symmetry of the transmissivity of the liquid crystal with respect to positive and negative drive voltages to prevent flickering and image persistence.

13 Claims, 19 Drawing Sheets

METHOD OF DRIVING LIQUID CRYSTAL DISPLAY DEVICE

FIELD OF THE INVENTION

The present invention relates to a method of driving a liquid crystal display device of an opposing signal line structure in which active three-terminal elements, each of which having a gate electrode connected to a scanning line, a drain electrode connected to a pixel electrode and a source electrode connected to a reference line, are arranged on a first substrate, signal lines are arranged on a second substrate facing the first substrate, and an electric field is applied to a liquid crystal layer between the pixel electrodes and the second substrate.

BACKGROUND OF THE INVENTION

In recent years, a liquid crystal panel has been often used as a display element of a word processor, personal computer, television set, etc. In order to produce such a liquid crystal panel, first, a number of films of metals, semiconductors or the like are formed on a light transmitting substrate such as glass. These films are patterned in a desired design by a photolithography technique to form two pieces of electrode substrates. The electrode substrates are then disposed to face each other and fastened with a predetermined space therebetween, and a liquid crystal is sealed in the space to provide the liquid crystal panel.

FIG. 11 shows a structure of a liquid crystal display device incorporating a generally used TFT (thin film transistor). Scanning lines 71, signal lines 72, TFTs 74 and pixel electrodes 75 are formed on a single glass substrate (first substrate). Moreover, as shown by an alternate lone and two sort dashes line, a common electrode 76 common to all pixels is formed on a surface of a glass substrate (second substrate, not shown), which surface faces the first substrate. The second substrate is disposed to face the first substrate with a liquid crystal layer (not shown) therebetween. Additionally, auxiliary capacitors CS (not shown) and reference lines (not shown) may be formed on the glass substrate (first substrate) having thereon the TFTs 74.

Regarding a driving method for providing a high-quality image with a liquid crystal display device of such a structure, for example, see "Drive System for TFT-LCDs Using Digital Drivers having Gray-Scale Interpolative Function, Hisao Okada, the Journal of the Institute of Image Information and Television Engineers, Vol.51, No.10, pp. 1768–1776(1997), published October, 1997.

According to this reference, when a TFT is in an ON state, an equivalent circuit of a single pixel of a liquid crystal display device of the above-mentioned structure is as shown in FIG. 12(*a*). On the other hand, when a TFT is in an OFF state, the equivalent circuit is as shown in FIG. 12(*b*).

When the TFT changes from the ON state to the OFF state, the voltage of the pixel electrode is lowered due to the effect of a transition of a gate voltage through a gate-drain parasitic capacitance Cg. Such a change of the electric potential of the pixel electrode causes the apparent non-symmetry of the transmissivity of liquid crystal with respect to positive and negative drive voltages. Thus, a high-quality image display is prevented.

Therefore, in order to display a high-quality image on the liquid crystal display device, the above reference discloses conditions to be satisfied by the drive voltages of the scanning lines, signal lines and common electrode. More specifically, the conditions include that the average of the common electrode drive voltage is lower than the average voltage of the signal line drive voltages by a predetermined amount ΔV, and the average voltage of the signal line drive voltages is increased with a decrease in the absolute value of a voltage to be applied to the liquid crystal (liquid crystal applied voltage), i.e., a decrease of the relative voltage difference between the signal line drive voltage and the common electrode drive voltage. The apparent non-symmetry of the transmissivity of the liquid crystal with respect to the positive and negative voltages are compensated by satisfying these conditions.

FIGS. 13 and 14 are given to explain the above contents. First, FIG. 14 shows the relationship between a common electrode drive voltage (common voltage) Vcom and a signal line drive voltage (gray-scale voltage) V0. In FIG. 14, V0A is a maximum value of V0, while V0B is a minimum value of V0. VcomH is a maximum value of Vcom, while VcomL is a minimum value of Vcom. As shown in FIG. 14, the average voltage of the common electrode drive voltage Vcom is lower than the average voltage of the signal line drive voltage V0 by ΔV (ΔV>0).

Further, FIG. 13 shows the relationship between the common electrode drive voltage Vcom and four signal line drive voltages (V0, V2, V5 and V7) in respect of the phases and ΔV, in accordance with the contents of the above reference. As shown in FIG. 13, the phases of V0 and V2 are inverted with respect to the phase of Vcom, while the phases of V5 and V7 are the same as the phase of Vcom. When Vcom is VcomL, among the whole signal line drive voltages, V0 applies a voltage V0A to the liquid crystal, while V7 applies a voltage V7A to the liquid crystal. V2 and V5 apply voltages (V2A, V5A) between V0A and V7A to the liquid crystal. Furthermore, when Vcom is VcomH, among the whole signal line drive voltages, V0 applies a voltage V0B to the liquid crystal, while V7 applies a voltage V7B to the liquid crystal. V2 and V5 apply voltages (V2B, V5B) between V0B and V7B to the liquid crystal.

Here, a gray-scale number is represented by n (n=0, 1, 2, . . . , 7), a liquid crystal applied voltage VLC is given by |Vn−Vcom|. For instance, V0A−VcomL. It is clear from FIG. 13 that the larger the gray-scale number n, the lower the liquid crystal applied voltage VLC.

Moreover, a curved line C1 in FIG. 13 connects the averages of the respective signal line drive voltages. Furthermore, FIG. 13 shows the average of Vcom by a straight light C2. It can be understood from the curved line C1 which rises toward the right that the greater the gray-scale number n, the higher the average of the signal line drive voltages and the larger the difference between the average of the signal line drive voltages and the average of Vcom.

Here, one reason why the results shown in FIGS. 13 and 14 are obtained is that the liquid crystal applied voltage VLC becomes lower as the gray-scale number n is increased, and consequently the amount of lowering of the voltage of the pixel electrode is increased. In other words, as the liquid crystal applied voltage VLC is lowered, the difference between the average of the positive and negative voltages of the liquid crystal applied voltage VLC and the average of Vcom as a reference is increased. Therefore, in order to minimize this difference, the technique disclosed in the above reference sets Vcom and the respective signal line drive voltages so that ΔV is increased in accordance with the difference. More specifically, Vcom is set for each signal line drive voltage so that the average of Vcom is lower than the average of each signal line drive voltage by just an amount of ΔV.

FIG. 15 shows a structure of a basic circuit corresponding to one output of a 3-bit digital driver (this circuit will be hereinafter referred to as a "unit drive circuit"). Data to be displayed is fetched in a sampling memory Msmp by a sampling pulse Tsmp, and then transferred to a holding memory MH by an output pulse LP. Next, the data stored in the holding memory MH is decoded in a decoder DEC. Then, an analog switch (ASW0, ASW1, . . . , or ASW7) corresponding to the value of the data is turned on, and the data is converted into a corresponding voltage and output as a signal line drive voltage (V0, V1, . . . , or V7). For instance, when the value of data is 0, the analog switch ASW0 is turned on, and the signal line drive voltage V0 supplied from an external device of the 3-bit digital driver is output to a corresponding signal line of the liquid crystal display device.

In general, one unit drive circuit is formed correspondingly to one signal line of the liquid crystal display device, and a collection of the unit drive circuits is generally called a driver. In FIG. 15, the voltages V0 to V7 are usually generated by an external circuit of the driver, and supplied to the driver. In general, a driver that generates these voltages is called a "gray-scale power supply", and its voltage is generally called a "gray-scale voltage" and serves as a signal line drive voltage. Namely, by setting the gray-scale voltage in the manner mentioned above, the signal line drive voltages are brought into the states shown in FIGS. 13 and 14.

Next, a schematic structure of the liquid crystal display device of the opposing signal line structure is illustrated in FIGS. 4 and 5. FIG. 4 is a perspective view, while FIG. 5 is a plan view. Here, a TFT is used as the active three-terminal element. On one substrate (first substrate), a gate electrode 17 of a TFT 14 is connected to a scanning line 11, a drain electrode 18 is connected to a pixel electrode 15, and a source electrode 19 is connected to a reference line 13 on the same substrate. The substrate on which the TFT 14 is formed will be hereinafter referred to as the "TFT substrate". As shown by the alternate long and two short dashes line of FIG. 5, formed on a substrate (second substrate) facing the TFT substrate is a signal line 12 made of a transparent conductor. In general, a transparent metal such as ITO (indium-tin oxide) is used as the transparent conductor which forms the signal line 12. Additionally, a liquid crystal layer is formed between the signal line 12 and the pixel electrode 15, and an electric field is applied to this liquid crystal layer. Such a structure is called the "opposing signal line structure".

As the liquid crystal display device having such an opposing signal line structure and a driving method thereof, Japanese laid-open patent application No. (Tokukaisho) 61-215590 (published Sep. 25, 1986, Zvi Yaniv et al., "Active display addressable without crossed lines on a substrate and method of using the same") illustrates the structure in which the voltages of the reference lines 13 shown in FIG. 5 are all ground potential or connected by a common connection. According to this publication, a driving method will be explained. Specifically, in FIG. 16, a is a scanning line drive voltage (gate voltage) waveform, b is a signal line drive voltage (gray-scale voltage) waveform, and c is a common electrode drive voltage waveform (or reference line drive voltage waveform). Through a TFT which is switched on when the scanning line drive voltage (a) is high, the corresponding pixel electrode is charged by a relative voltage difference between the signal line drive voltage (b) and the common electrode drive voltage (c). In order to apply an AC voltage to the liquid crystal, it is necessary to invert the signal line drive voltage (b) with respect to the common electrode drive voltage (c).

Moreover, the above Japanese laid-open patent application No. (Tokukaisho) 61-215590 explains the decrease of the amplitude of the signal line drive voltage (b) by arranging the common electrode drive voltage (c) to have a rectangular wave. This is based on the same concept as the AC-driving of the common electrode of a liquid crystal display device having no opposing signal line structure. Since the AC-driving of the common electrode is disclosed in the above-mentioned reference "Drive System for TFT-LCDs Using Digital Drivers having Gray-Scale Interpolative Function, Hisao Okada, the Journal of the Institute of Image Information and Television Engineers, Vol.51, No.10, pp.1768–1776 (1997), the explanation thereof will be omitted here.

When the liquid crystal display device of the opposing signal line structure is operated by a drive method which does not consider a lowering of the voltage of the pixel electrode, like a conventional structure, the above-mentioned apparent non-symmetry of the transmissivity of the liquid crystal with respect to positive and negative drive voltage occurs. Therefore, there is a possibility that phenomena such as flickering and image persistence appear, and a high-quality image display can not be provided.

On other hand, in the liquid crystal display device having the above-described conventional structure instead of the opposing signal line structure, the cause of the non-symmetry and the compensation method are proposed in the above-mentioned reference. It is therefore possible to compensate for the apparent non-symmetry of the transmissivity of the liquid crystal with respect to positive and negative drive voltages as disclosed in the reference, and consequently prevent the phenomena such as flickering and image persistence to provide a high-quality image display.

However, in the liquid crystal display device of the opposing signal line structure, since the structure is completely different, it is impossible to compensate for the non-symmetry by the method disclosed in the above-mentioned reference. Thus, there is a problem that a high-quality image display without defects such as flickering and image persistence can not be provided.

SUMMARY OF THE INVENTION

An object of the present invention is to provide a method of driving a liquid crystal display device of the opposing signal line structure, which is capable of achieving a high quality image display by compensating for the non-symmetry of the transmissivity of the liquid crystal with respect to positive and negative drive voltages to prevent flickering and image persistence.

In order to achieve the object, a method of driving a liquid crystal display device of the present invention is a method of driving a liquid crystal display device in which an active three-terminal element having a gate electrode connected to a scanning line, a drain electrode connected to a pixel electrode and a source electrode connected to a reference line is arranged on a first substrate, a signal line is arranged on a second substrate which faces the first substrate, and an electric field is applied to a layer of liquid crystal between the pixel electrode and the second substrate, and characterized by setting an average voltage of reference line drive voltages for AC-driving the liquid crystal to be higher than an average voltage of signal line drive voltages.

According to this structure, the average voltage of the reference line drive voltages for AC-driving the liquid crystal is set higher than the average voltage of the signal line drive voltages.

It is therefore possible to compensate for the apparent non-symmetry of the transmissivity of the liquid crystal with respect to positive and negative drive voltages. Hence, with the method of driving the liquid crystal display device of the opposing signal line structure, a high-quality image display can be achieved.

For a fuller understanding of the nature and advantages of the invention, reference should be made to the ensuing detailed description taken in conjunction with the accompanying drawings.

DESCRIPTION OF THE PREFERRED EMBODIMENTS

[First Embodiment]

The following description will explain an embodiment of the present invention with reference to FIGS. 1 to 9, and 17 to 19.

Figure 4:
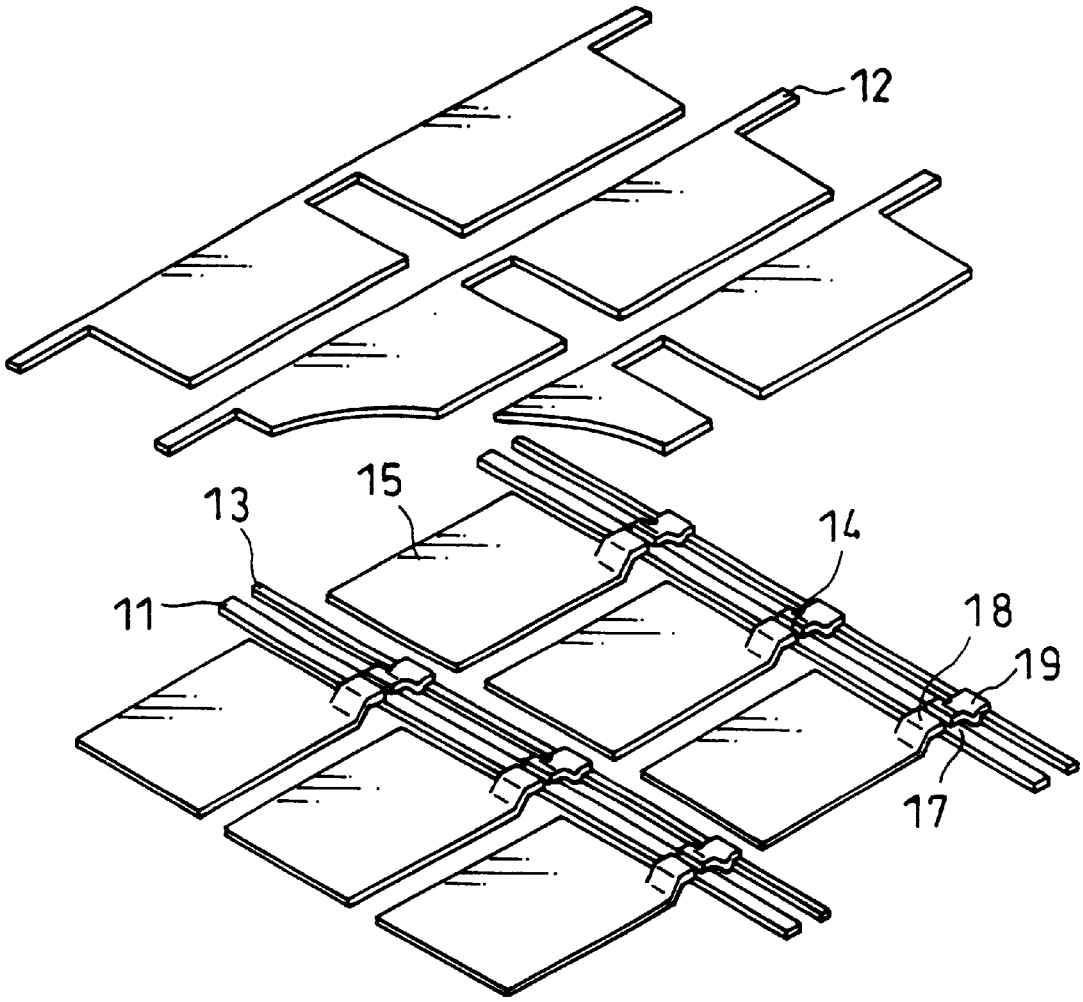
FIG. 4 is a perspective view showing schematic structures of essential sections of a liquid crystal display device to which the method of driving a liquid crystal display device of the present invention is applied.
Figure 5:
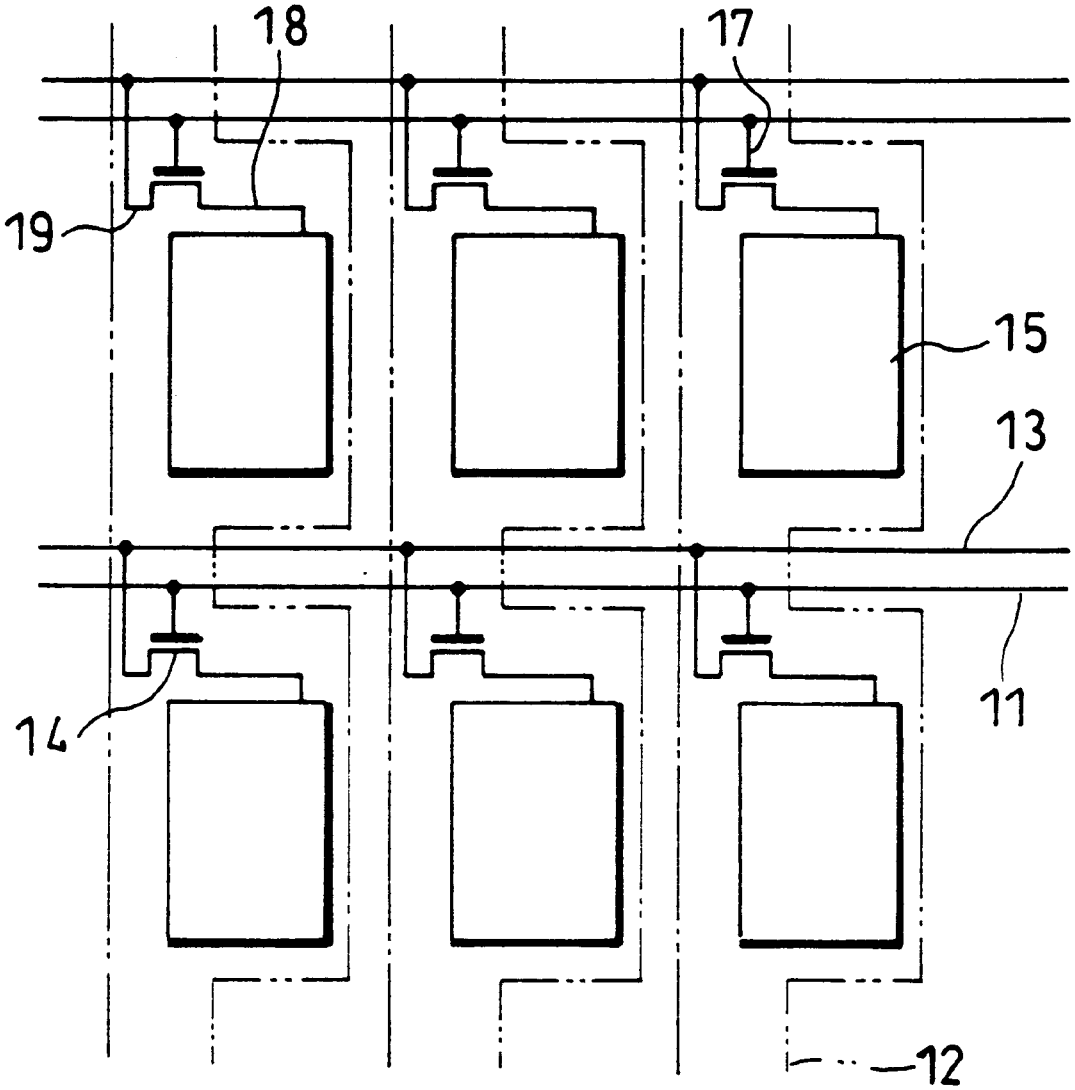
FIG. 5 is a plan view showing schematic structures of essential sections of a liquid crystal display device to which the method of driving a liquid crystal display device of the present invention is applied.

According to this embodiment, a liquid crystal display device has the opposing signal line structure. Here, as illustrated in FIGS. 4 and 5, a TFT (thin film transistor) is used as an active three-terminal element. On one substrate (first substrate) , a gate electrode 17 of a TFT 14 is connected to a scanning line 11, a drain electrode 18 is connected to a pixel electrode 15, and a source electrode 19 is connected to a reference line 13 on the same substrate. The substrate on which the TFT 14 is formed will be hereinafter referred to as the "TFT substrate". As shown by the alternate long and two short dashes line of FIG. 5, formed on the substrate (second substrate) facing the TFT substrate is a signal line 12 made of a transparent conductor. In general, as the transparent conductor which forms the signal line 12, a transparent metal such as ITO (indium-tin oxide) is used. Additionally, a liquid crystal layer is formed between the signal line 12 and the transparent pixel electrode 15, and an electric field is applied to this liquid crystal layer.

Incidentally, in the liquid crystal display device of this embodiment, although the TFT is used as the active three-terminal element, the active three terminal element is not necessarily limited to the TFT.

Figure 6:
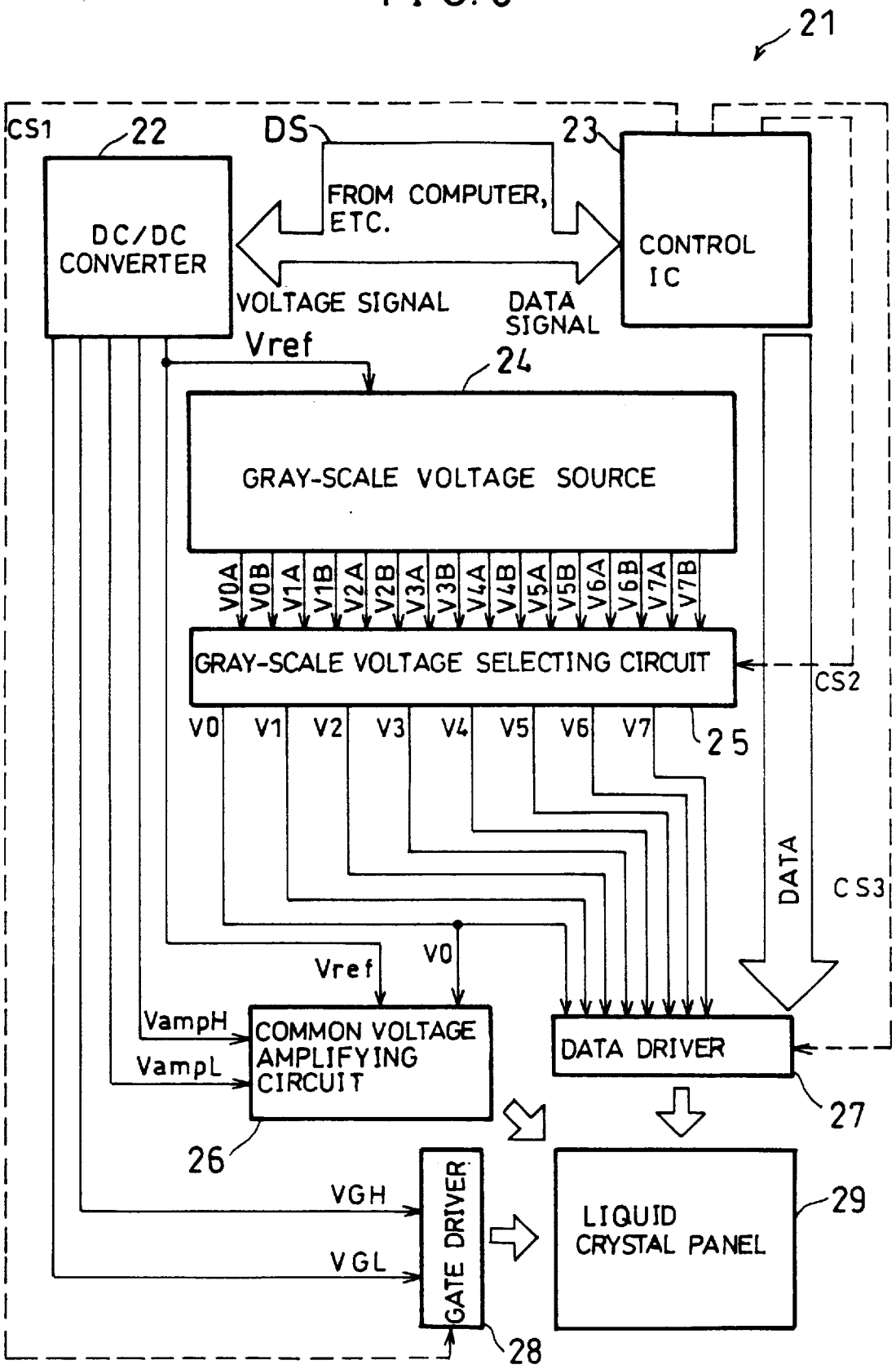
FIG. 6 is a block diagram showing schematic structures for generating voltage signals according to the present invention.

Referring now to FIG. 6, the following description will explain the structure and a basic operation of a drive circuit (voltage control means) 21 as a digital driver for driving the liquid crystal display device. In this embodiment, the drive circuit is a 3-bit digital driver. However, the drive circuit is not necessarily limited to the 3-bit digital driver.

This drive circuit 21 AC-drives (rectangular-wave-drives) a reference line drive voltage of the liquid crystal display device to decrease the amplitude of a signal line drive voltage.

Digital signals DS including one or more kinds of power supply and clock are input to a block of the drive circuit 21 of the liquid crystal display device from a computer, etc.

Voltage signals included in the digital signals DS are input to a DC/DC converter 22 as a constant voltage generating circuit, converted into several types of constant voltages, and then output. Specifically, the following are output:

(1) gate voltages VG, i.e., VGH (in a high state) and VGL (in a low state), to be input to a gate driver 28;

(2) voltages Vamp, i.e., VampH (in a high state) and VampL (in a low state), to be input to a common voltage amplifying circuit 26 constituted by a later-described Class B amplifying circuit or the like, for current amplification of the reference line drive voltage;

(3) an arbitrary constant voltage Vref which is the base of the signal line drive voltage; and (4) an IC drive-use constant voltage power supply necessary for each IC (not shown) itself to execute the operation.

Besides, the voltages may be stabilized by inserting a regulator circuit (not shown), etc. just before each IC.

Additionally, data signals included in the digital signals DS are input to a control IC 23, and various later-described control signals are output from the control IC 23 based on the data signals.

The gate voltages VGH and VGL are input to the gate driver 28. Moreover, a control signal CS1 such as a vertical start pulse, vertical shift clock or the like from the control IC23 is input to the gate driver 28. As a result, either VGH or VGL is selected in the gate driver 28, and applied as a scanning line drive voltage waveform to a liquid crystal panel 29.

Besides, the DC/DC converter 22 supplies the arbitrary constant voltage Vref to a gray-scale voltage source 24 as a constant voltage source of the signal line drive voltages of each gray scale. The gray-scale voltage source 24 generates the gray-scale voltage (signal line drive voltage) from Vref by resistance division, etc. Here, in order to AC-drive the liquid crystal, two kinds of signal line drive voltages are necessary for each gray scale. Therefore, in order to achieve 3-bit 8 gray scales, 16 (2×8) kinds of signal line drive voltages (V0A, V0B, . . . , V7A, and V7B) are generated.

V0A and V0B are values that the binary signal line drive voltage V0 can take. Similarly, for instance, V1A and V1B are values that the binary signal line drive voltage V1 can take for one gray scale. The same can be said for the following signal line drive voltages. Thus, each of the signal line drive voltages V0, V1, V2, V3, V4, V5, V6 and V7 of the respective gray scales can take either of the two voltage values.

The reference line drive voltage Vcom has a value VcomH in a high state, and a value VcomL in a low state.

In this explanation, "A" is added to the signal line drive voltages which are generated when VcomL is applied as the reference line drive voltage. Namely, the signal line drive voltages are expressed as V0A, V1A, V2A, . . . , V7A. Meanwhile, "B" is added to the signal line drive voltages which are generated when VcomH is applied as the reference line drive voltage. Namely, the signal line drive voltages are expressed as V0B, V1B, V2B, . . . , V7B.

The above-mentioned 16 kinds of signal line drive voltages (V0A to V7A, V0B to V7B) are input to a gray-scale voltage selecting circuit 25. In the gray-scale voltage selecting circuit 25, the signal line drive voltages are timely switched between "A" and "B" according to the control signal CS2 from the control IC23 to output the signal line drive voltages of the two groups V0A to V7A and V0B to V07 alternately. Thereafter, the signals of voltages V0 to V7 are input to the gray-scale voltage input terminal of the data driver 27. The data driver 27 selects one of the voltages V0 to V7 input to the gray-scale voltage input terminal according to a data signal for each data line, and outputs the selected signal to the liquid crystal panel 29.

By the way, in this embodiment, the drive circuit 21 sets the average voltage of the reference line drive voltages for AC-driving the liquid crystal to a value higher than the average voltage of the signal line drive voltages. This will be explained in detail below.

Figure 7:
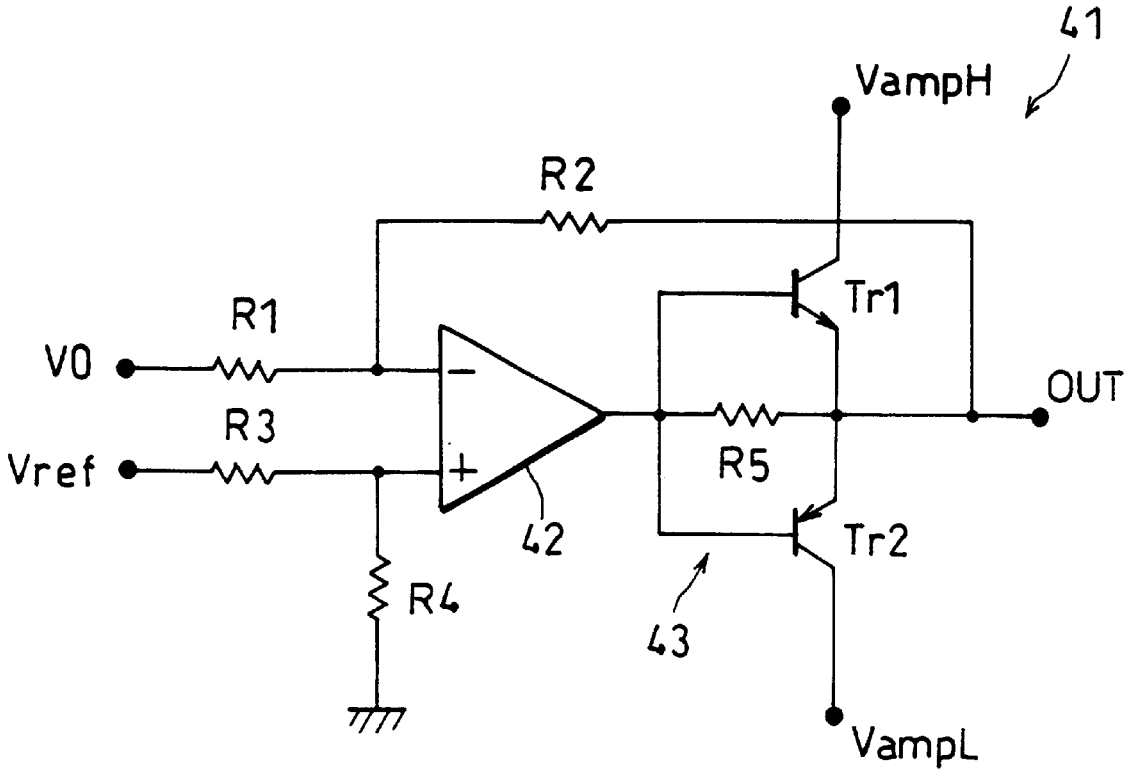
FIG. 7 is a circuit diagram showing a schematic structure for generating a reference line drive voltage according to the present invention.

First, a method of generating a drive waveform of the reference line drive voltage Vcom will be explained. As illustrated in FIG. 7, a differential amplifier circuit 41 using an operational amplifier is used. This differential amplifier circuit 41 is equivalent to the above-mentioned common voltage amplifying circuit 26. Here, with the use of the waveform of the signal line drive voltage V0, a reference line drive voltage waveform is output. More specifically, Vcom is synthesized using two voltages, i.e., the signal line drive voltage V0 and the above-mentioned arbitrary constant voltage Vref.

The input voltage Vref and V0 are input to an operational amplifier 42. A Class B amplifier 43 for amplifying a current is connected to the output section of the operational amplifier 42. The voltage VampH supplied to the Class B amplifier 43 is higher than VcomH representing a high state of the output reference line drive voltage by an amount of about 1 V or more, while the voltage VampL supplied to the Class B amplifier 43 is lower than VcomL representing a low state of the output reference line drive voltage by an amount of about 1 V or more.

In other words, when applying the voltages VcomH and VcomL to the liquid crystal panel, it is necessary to amplify the current because the load of the liquid crystal panel is large. In this case, in an actual circuit using the transistor, a voltage drop of around 0.7 to 1.0 V is present in the transistor due to the characteristics of silicon. Therefore, in the actual circuit, VampL is set lower than VcomL by an amount of about 1 V or more by leaving a margin.

When a resistor R5 in the Class B amplifier 43 is ignored, the reference line drive voltage Vcom is given by $$Vcom=(R4/R1)(R1+R2)/(R3+R4)Vref-(R2/R1)V0 \quad (1).$$

Here, when V0 is V0A and V0B, since Vcom are VcomL and VcomH, respectively, above equation (1) is established respectively. Namely, the following two equations, (2) and (3), are expressed.

$$VcomL=(R4/R1)(R1+R2)/(R3+R4)Vref-(R2/R1)V0A \quad (2)$$

$$VcomH=(R4/R1)(R1+R2)/(R3+R4)Vref-(R2/R1)V0B \quad (3)$$

The average of the reference line drive voltages (Center of Vcom, or called Vcomc), and the average of V0 (Center of V0, or called V0c) with a black display of the gray-scale voltage (signal line drive voltage) as a reference are respectively expressed as follows.

$$Vcomc=(VcomH+VcomL)/2$$

$$V0c=(V0A+V0B)/2$$

This embodiment sets $$Vcomc>V0c \quad (4).$$

Thus, $$(VcomH+VcomL)/2>(V0A+V0B)/2.$$

VcomH and VcomL are deleted by this and above equations (2) and (3) to express $$2(R4/R1)\{(R1+R2)/(R3+R4)\}Vref-(1+R2/R1)(V0A+V0B)>0 \quad (5).$$

In short, by setting resistors R1 to R4 to satisfy the condition of expression (5), driving satisfying the relationship of (4) can be achieved.

Here, at the signal line drive voltage (gray-scale voltage) V0, when V0A=Vref, and V0B=0, it is possible to achieve driving satisfying the relationship of (4) by setting the condition of following expression (6)

$$R4-R3>0 \quad (6).$$

In the above explanation, the resistors R4 and R3 are set by two resistances. However, the condition can also be satisfied equivalently by means of two or more fixed resistances or variable resistances.

Next, the specific value of the difference in inequality (4) will be explained.

Figure 3A:
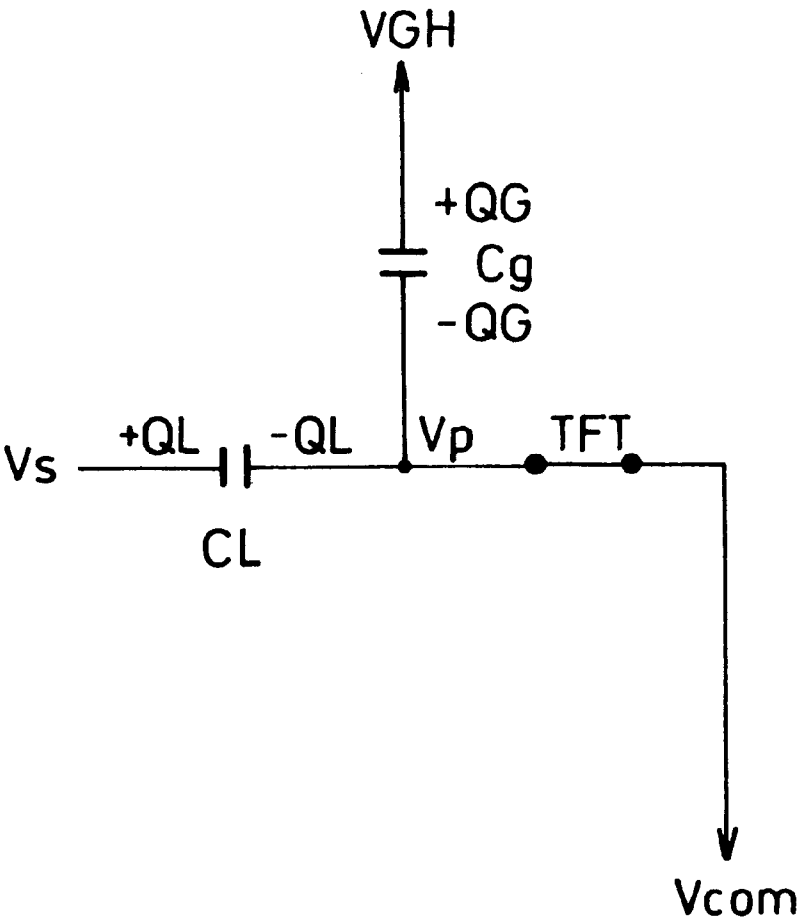
FIGS. 3(*a*) and 3(*b*) are circuit diagrams showing an equivalent circuit of a pixel section of a liquid crystal display device to which the method of driving a liquid crystal display device of the present invention is applied.
Figure 3B:
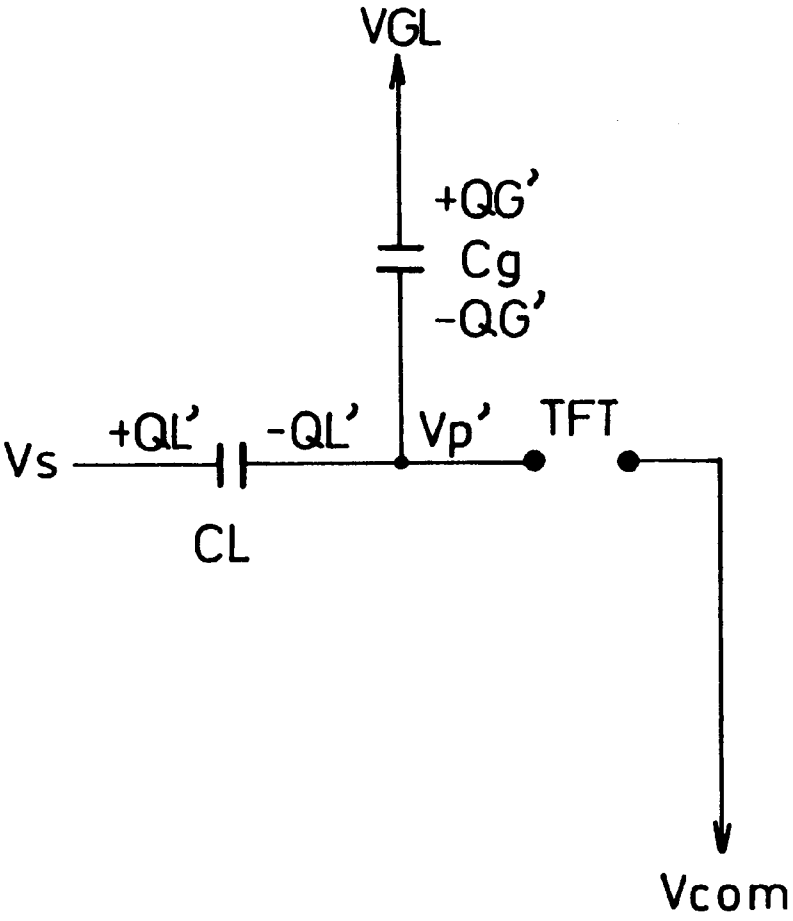

FIGS. 3(*a*) and 3(*b*) show an equivalent circuit corresponding to a single pixel of a liquid crystal display device of the opposing signal line structure as an object to be driven by the present invention. FIG. 3(*a*) shows the equivalent circuit of a single pixel in an ON period of the TFT. FIG. 3(*b*) shows the equivalent circuit of a single pixel in an OFF period of the TFT.

In FIGS. 3(*a*) and 3(*b*), CL is a capacitance (hereinafter simply referred to as the "pixel capacitance) formed by the pixel electrode and a portion of the signal line facing the pixel electrode. Cg is the sum of a capacitance (parasitic capacitance) formed between the gate line or the gate electrode of the TFT and the pixel electrode or the drain electrode (electrode on the pixel electrode side) of the TFT. When the TFT is in an ON state, the voltages and charges QL and QG at the respective sections are indicated as shown in FIG. 3(*a*). More specifically, the electric potential of Cg and CL on the TFT side, i.e., electric potential of the pixel electrode is denoted by Vp. The signal line drive voltage (generally called Vs) is applied to the other terminal of CL. In the case of AC-driving, Vs is either VnH or VnL (VnH>VnL) (where n is a gray scale number). Charges accumulated in CG and CL are denoted by QG and QL, respectively. The other electric potential of the TFT is the reference line drive voltage Vcom. Vcom is either VcomH or VcomL (VcomH>VcomL). The other electric potential of Cg is VGH as an ON voltage of the gate.

At this time, following equations (7) and (8) are established.

$$QL=CL(Vs-Vp) \quad (7)$$

$$QG=Cg(VGH-Vp) \quad (8)$$

Regarding the voltages and charges at the respective section after a transition of the TFT from the ON state to the OFF state, as shown in FIG. 3(*b*), the electric potential of Cg and CL on the TFT side is denoted by VP' and the charges accumulated in Cg and CL are denoted by QG' and QL', respectively. The other electric potential of Cg changes to VGL as an OFF voltage of the gate. At this time, following equations (9) and (10) are established.

$$QL'=CL(Vs-Vp') \quad (9)$$

$$QG'=Cg(VGH-Vp') \quad (10)$$

Here, the reason why the signal line drive voltage has the same value (Vs) as the voltage in the ON state of the TFT is that the data driver 27 (see FIG. 6) as a circuit for supplying the signal line drive voltage continues to output the voltage in the ON state of the TFT. After the TFT is completely switched off, the data driver 27 outputs a voltage with respect to the next data.

Figure 17:
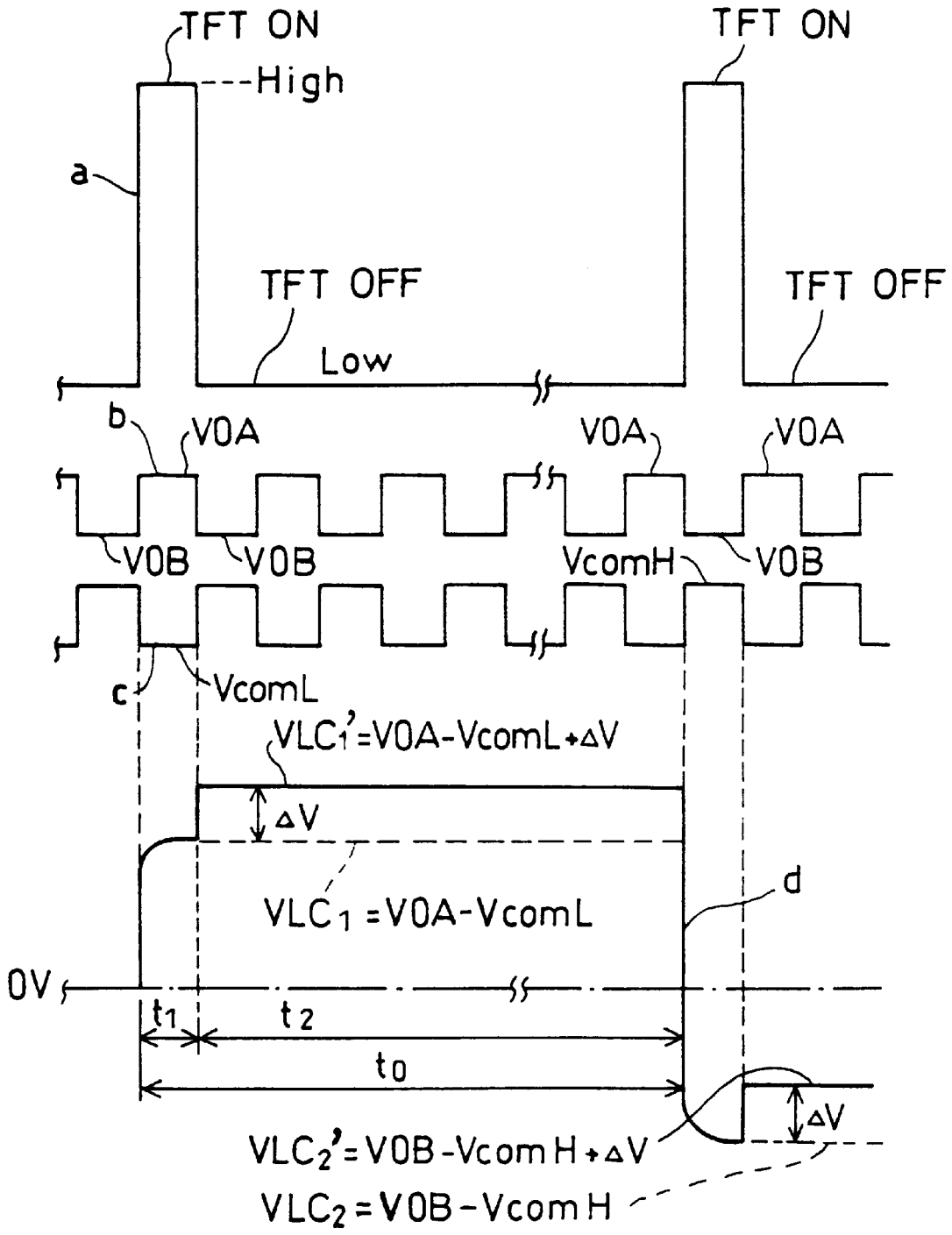
FIG. 17 is an explanatory view showing the waveforms of scanning line drive voltage, gray-scale voltage, reference line drive voltage, and liquid crystal applied voltage.

An example where Vs is V0 (i.e. V0A and V0B) will be explained with reference to FIG. 17. In FIG. 17, a is the waveform of the scanning line drive voltage (gate voltage), b is the waveform (V0) of the signal line drive voltage (source voltage, gray-scale voltage), c is the waveform (Vcom) of the reference line drive voltage (common voltage), and d is the waveform of the liquid crystal applied voltage. The liquid crystal applied voltage is given by subtraction of the reference line drive voltage (c) from the signal line drive voltage (b).

(I) As shown in the left of FIG. 17, the TFT is switched on after the signal line drive voltage changes from V0B to V0A, and is switched off just before the signal line drive voltage changes from V0A to V0B. As a result, at the time the TFT is switched off, the data driver 27 continues to output V0A as the voltage in the ON state of the TFT. Therefore, above equations (7) and (9) are rewritten to following equations (7a) and (9a), respectively.

$$QL=CL(V0A-Vp) \quad (7a)$$

$$QL'=CL(V0A-Vp') \quad (9a)$$

As the liquid crystal applied voltage, the value just after switching off the TFT is kept until the TFT, i.e., the gate voltage is switched on again, while the charge QL' just after switching off the TFT is kept until the TFT is switched on again.

(II) Moreover, as shown in the right of FIG. 17, the TFT is switched on after the signal line drive voltage changes from V0A to V0B, and is switched off just before the signal line drive voltage changes from V0B to V0A. Consequently, at the time the TFT is switched off, the data driver 27 continues to output V0B as the voltage in the ON state of the TFT. Therefore, above equations (7) and (9) are rewritten to following equations (7b) and (9b), respectively.

$$QL=CL(V0B-Vp) \quad (7b)$$

$$QL'=CL(V0B-Vp') \quad (9b)$$

Similarly to the above, as the liquid crystal applied voltage, the value just after switching off the TFT is kept until the TFT, i.e., the gate voltage is switched on again, while the charge QL' just after switching off the TFT is kept until the TFT is switched on again.

By the way, since the charge is approximately stored before and after the switching on the TFT, when the above-mentioned electric potential is Vp or Vp', the following equation is established.

$$-QL-QG=-QL'-QG'$$

By inserting above four equations (7) to (10) to this equation to solve Vp'−Vp, equation (11) is given.

$$Vp'-Vp=-\alpha(VGH-VGL) \quad (11)$$

Here, it is defined that $$\alpha=Cg/(CL+Cg) \quad (12).$$

Moreover, by defining a decrease ΔV of the electric potential of the pixel electrode in the transition of the TFT from the ON state to the OFF state by $$\Delta V=Vp-Vp'=\alpha(VGH-VGL) \quad (13),$$

ΔV>0 according to equations (13) and (12). Hence, it should be understood that Vp is lowered by an amount ΔV(>0).

Next, assuming that the voltage applied to the liquid crystal (liquid crystal voltage) changes from VLC to VLC' during the transition of the TFT from the ON state to OFF state as discussed above. Then, the respective liquid crystal applied voltages are written as $$VLC=Vs-Vp \quad (14),$$

and $$VLC'=Vs-Vp' \quad (15).$$

By above equation (13) and the fact that the Vp=Vcom when the TFT is in the ON state, VLC and VLC' are respectively given by $$VLC=Vs-V\text{com} \quad (16),$$

and $$VLC'=Vs-V\text{com}+\Delta V \quad (17).$$

Thus, it can be understood that the liquid crystal applied voltage is shifted by the amount ΔV in a positive direction when the TFT changes from the ON state to OFF state. As a result, the non-symmetry of the transmissivity of the liquid crystal appears and prevents a high-quality display.

Figure 2:
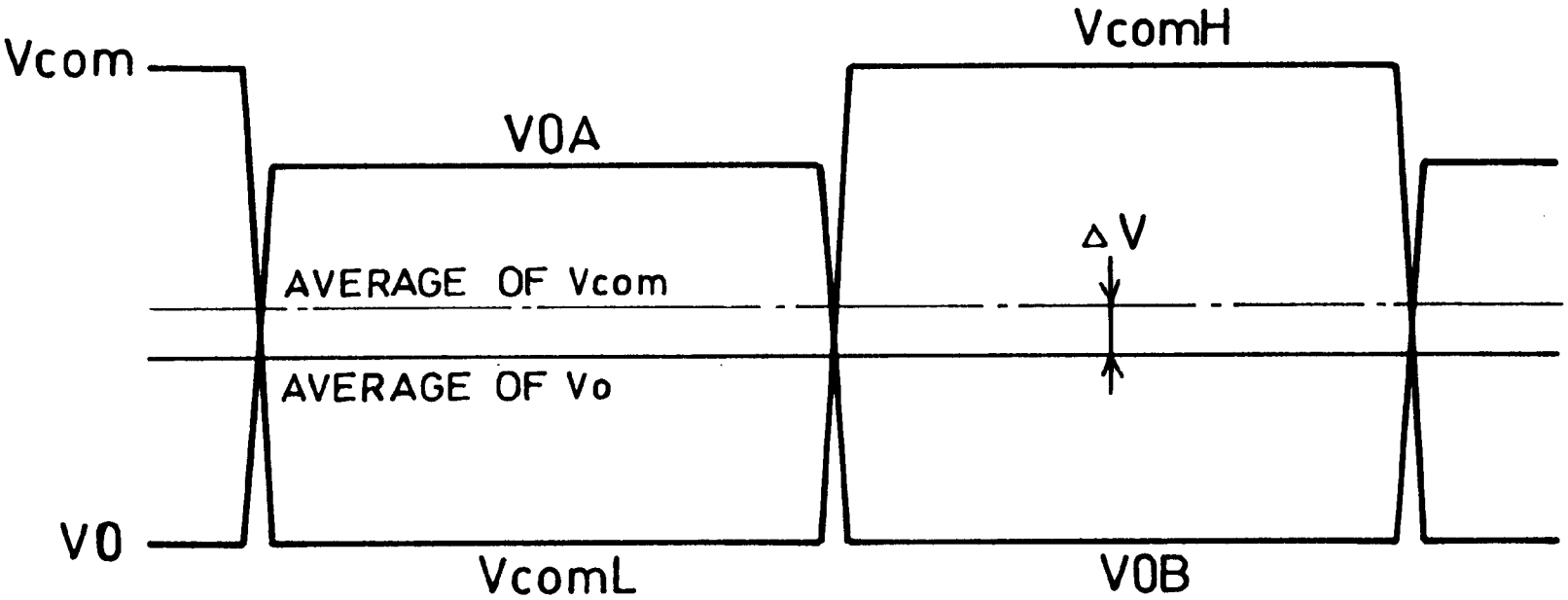
FIG. 2 is a graph showing the relationship between the reference line drive voltage and a maximum gray-scale voltage applied to a liquid crystal when the reference line drive voltage is an AC voltage according to the present invention.

In this embodiment, therefore, in order to cancel the non-symmetry due to ΔV, the average of the reference line drive voltages Vcom is set higher than the average of the signal line drive voltages (gray-scale voltages) Vs, i.e., the average of the signal line drive voltage V0 as shown in FIG. 2, for example, by the amount ΔV.

More specifically, for example, in the case of the signal line drive voltage V0, when the reference line drive voltage is an AC voltage, as shown in the left of d of FIG. 17, the corresponding pixel electrode is charged as expressed by $$VLC_1=V0A-V\text{com}L \quad (16a)$$

according to equation (16) during the first charging, but the liquid crystal applied voltage immediately changes from equation (17) to $$VLC_1'=V0A-V\text{com}L+\Delta V \quad (17a)$$

because the TFT is switched off just before the end of a period in which the signal line drive voltage keeps V0A. Until the TFT of the pixel is switched on again, the value of $VLC_1'$ continues to be kept. Here, between the switching on the TFT of a certain pixel and the switching on again the TFT of the certain pixel, it takes a time (shown as $t_o$ in FIG. 17) for switching on and off a number of TFTs equal to the number of gates. Therefore, compared with a time (shown as $t_1$ in FIG. 17) between the switching on the TFT and the switching off the TFT in a period in which V0A is kept, a time (shown as $t_2$ in FIG. 17) between the switching off the TFT and the switching on again the TFT of the pixel is sufficiently longer. As a result, in almost all a period from the start of this charging to the start of the next charging, the liquid crystal applied voltage will keep the value of $VLC_1'$.

This is the same in the following second charging. More specifically, as shown in the right of d of FIG. 17, the corresponding pixel electrode is charged as shown by $$VLC_2=V0B-V\text{com}H \quad (16b)$$

according to equation (16), but the liquid crystal applied voltage immediately changes from equation (17) to $$VLC_2'=V0B-V\text{com}H+\Delta V \quad (17b)$$

because the TFT is switched off just before the end of a period in which the signal line drive voltage keeps V0B. As a result, for the same reason as above, in almost all a period from the start of the second charging to the start of the next charging, the liquid crystal applied voltage will keep the value of $VLC_2'$.

The liquid crystal applied voltage is ideally switched between the positive value $VLC_1$ and negative value $VLC_2$ alternately. Since these values have the same absolute value, the transmissivity of the liquid crystal exhibits symmetry with respect to the positive and negative drive voltages. In actual fact, however, since ΔV is produced as described above, the liquid crystal applied voltage is switched between the positive value $VLC_1'$ and negative value $VLC_2'$ alternately. Further, since the absolute values of these values are different from each other, apparent non-symmetry of the transmissivity of the liquid crystal will appear with respect to the positive and negative drive voltage.

Therefore, in this embodiment, the absolute values of the positive and negative voltages are made equal to each other by changing the reference line drive voltage Vcom to Vcom* as described below, so that the transmissivity of the liquid crystal has symmetry with respect to the positive and negative drive voltages.

First, in the first charging, as shown in the left of d of FIG. 17, since a period in which the liquid crystal applied voltage is $VLC_1$ is only a short time, this period is ignored, and the phenomenon that the liquid crystal applied voltage becomes higher than the target $VLC_1$ by ΔV as shown by equation (17a) is substantially cancelled. In other words, in this embodiment, in order to cause the liquid crystal applied voltage to be always equal to the target $VLC_1$, VcomL is changed to VcomL* given by following equation (18).

$$V\text{com}L^*=V\text{com}L+\Delta V \quad (18)$$

As a result, $VLC_1'$ in equation (17a) changes to $$VLC_1^{*\prime}=V0A-V\text{com}L^*+\Delta V \quad (17c).$$

Therefore, according to equations (18) and (16a), $$VLC_1^{*\prime}=V0A-(V\text{com}L+\Delta V)+\Delta V=V0A-V\text{com}L=VLC_1.$$

The same can be said for the second charging. More specifically, as shown in the right of d of FIG. 17, since a period in which the liquid crystal applied voltage is $VLC_2$ is only a short time, this period is ignored and the phenomenon that the liquid crystal applied voltage is higher than the target $VLC_2$ by ΔV as shown by above equation (17b) is substantially cancelled. In other words, in this embodiment, in order to cause the liquid crystal applied voltage to be always equal to the target $VLC_2$, VcomH is changed to VcomH* given by following equation (19).

$$V\text{com}H^*=V\text{com}H+\Delta V \quad (19).$$

As a result, $VLC_2'$ in above equation (17) changes to $$VLC_2^{*\prime}=V0B-V\text{com}H^*+\Delta V \quad (17d)$$

Therefore, according to equations (19) and (16b), $$VLC_2^{*\prime}=(V0B-V\text{com}H+\Delta V)+\Delta V=V0B-V\text{com}H=VLC_2.$$

In the above explanation, although V0 was mentioned, the same can be said for V2, V5, etc.

Here, according to above equations (18) and (19), $$V\text{com}H^*+V\text{com}L^*=V\text{com}H+V\text{com}L+2\Delta V$$

$$(V\text{com}H^*+V\text{com}L^*)/2=(V\text{com}H+V\text{com}L)/2+\Delta V$$

$$\therefore(\text{Average of } V\text{com}^*)=(\text{Average of } V\text{com})+\Delta V \quad (20).$$

On the other hand, assuming that the above-described ΔV is not produced, in order to ensure the symmetry of the transmissivity of the liquid crystal with respect to the positive and negative drive voltages as mentioned above, the average of the signal line drive voltages Vs (V0A, V0B, V2A, V2B, . . . ) and the average of the reference line drive voltages Vcom are equal to each other. Namely, $$(\text{Average of } V\text{com})=(\text{Average of } Vs) \quad (21).$$

For example, $$(V\text{com}H+V\text{com}L)/2=(V0A+V0B)/2.$$

Therefore, $VLC_1$=V0A−VcomL and $VLC_2$=V0B−VcomH have opposite signs and the same absolute value, i.e., are symmetrical.

Hence, according to above equations (20) and (21), $$(\text{Average of } V\text{com}^*)=(\text{Average of } Vs)+\Delta V \quad (22).$$

In other words, in this embodiment, by causing the average of the reference line drive voltages to be higher than the average of the signal line drive voltages by the amount ΔV, in either of the A section (the V0A section in the above example) and B section (the V0B section in the above example), the reference line drive voltages are made higher than the original values VcomL and VcomH, respectively, by the amount ΔV. It is therefore possible to cause the liquid crystal applied voltage to be the target value $VLC_1$ in the A section, and cause the liquid crystal applied voltage to be the target value $VLC_2$ in the B section. Hence, the liquid crystal applied voltage is switched between the positive value $VLC_1$ and negative value $VLC_2$ alternately. Since these values have the same absolute value, the transmissivity of the liquid crystal exhibits symmetry with respect to the positive and negative drive voltages.

It is thus possible to compensate for the apparent non-symmetry of the transmissivity of the liquid crystal with respect to the positive and negative drive voltages. Consequently, a high-quality image display can be achieved with the liquid crystal display device of the opposing signal line structure.

Next, the following description will explain the relationship between the setting of Vcom and the signal line drive voltages (gray-scale voltages).

Figure 1:
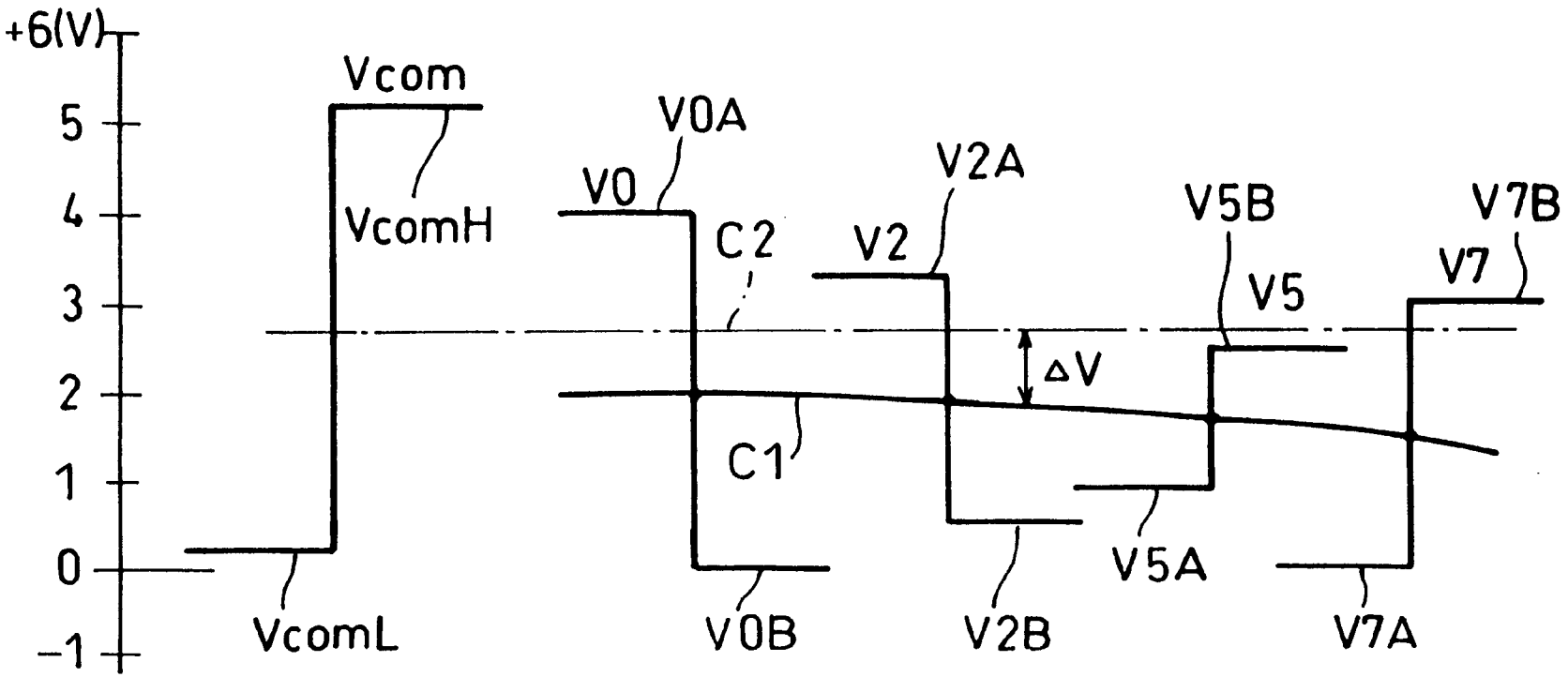
FIG. 1 is a graph showing the relationship between a reference line drive voltage and each gray-scale voltage when the reference line drive voltage is an AC voltage according to a method of driving a liquid crystal display device of the present invention.

FIG. 1 shows the relationship between the reference signal line drive voltage Vcom and four signal line drive voltages (V0, V2, V5 and V7) in respect of the phases and AV. As shown in FIG. 1, the phases of V0 and V2 are inverted with respect to the phase of Vcom, while the phases of V5 and V7 are the same as the phase of Vcom. When Vcom is VcomL, V0 applies the voltage V0A to the liquid crystal, while V7 applies the voltage V7A to the liquid crystal. V2 and V5 apply voltages (V2A and V5A) between V0A and V7A. On the other hand, when Vcom is VcomH, V0 applies the voltage V0B to the liquid crystal, while V7 applies the voltage V7B to the liquid crystal. V2 and V5 apply voltages (V2B and V5B) between V0B and V7B. Therefore, when the gray-scale number is expressed as n (n=0, 1, 2, . . . , 7), the voltage (liquid crystal applied voltage) VLC as the absolute value to be applied to the liquid crystal is represented by |Vn−Vcom|. For example, V0A−VcomL.

It should be understood from FIG. 1 that the greater the gray-scale number n, the lower the liquid crystal applied voltage VLC. More specifically, in FIG. 1 showing V0, V2, V5 and V7, since $$V0A>V2A>V5A>V7A$$

and $$V0B<V2B<V5B<V7B,$$

the liquid crystal applied voltages are $$V0A-V\text{com}L>V2A-V\text{com}L>V5A-V\text{com}L>V7A-V\text{com}L,$$

and $$V\text{com}H-V0B>V\text{com}H-V2B>V\text{com}H-V5B>V\text{com}H-V7B.$$

Thus, the liquid crystal applied voltages VLC becomes smaller in the order of V0, V2, V5 and V7.

Moreover, in FIG. 1, the curved line C1 connects the averages of the respective signal line drive voltages. Further, in FIG. 1, the average of Vcom is also shown by the straight line C2. Since the curved line C1 is declined toward the right, it can be understood that the average of the signal line drive voltages of each gray scale is lowered with an increase in the gray-scale number n, i.e., with a lowering of the liquid crystal applied voltage VLC. As a result, the difference (ΔV) between the average of the signal line drive voltages of each gray scale and the average of Vcom is increased.

Figure 8:
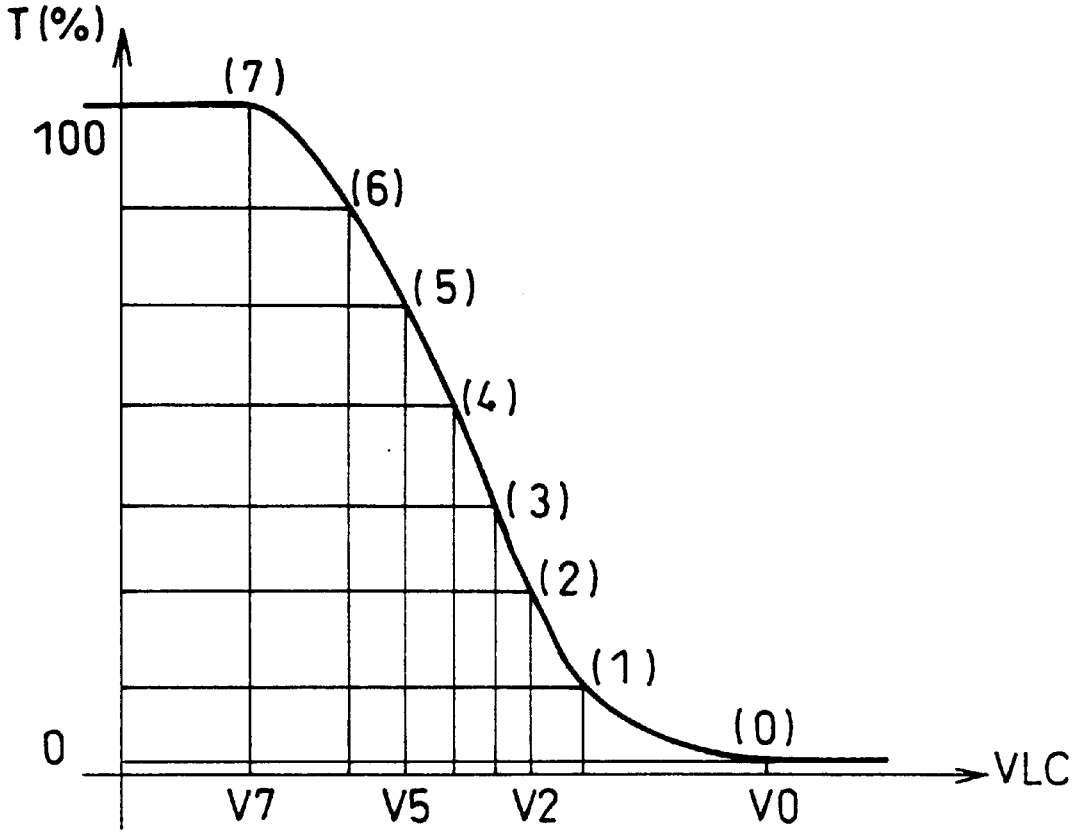
FIG. 8 is a graph showing the relationship between the applied voltage and the transmissivity of a TN-mode liquid crystal.

This is because the liquid crystal material of a TN (twisted nematic) mode generally has the following characteristics. The general relationship between a liquid crystal applied voltage VLC and a transmissivity T of the TN mode used in normally white mode (in which white is displayed when no voltage is applied to the liquid crystal) is shown in FIG. 8. When the voltage VLC actually applied to the liquid crystal is low, the transmissivity T is high, and a white display is provided. On the other hand, when VLC is high, the transmissivity T is low, and a black display is provided.

Figure 9:
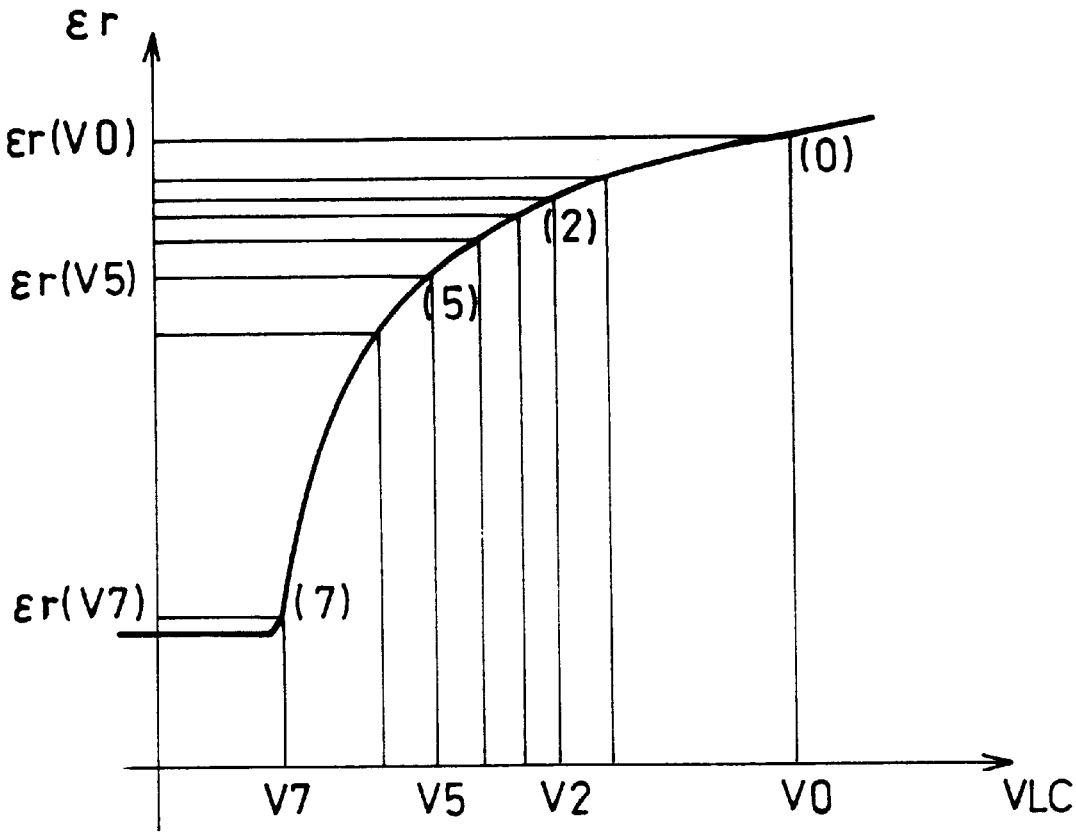
FIG. 9 is a graph showing the relationship between the applied voltage and the relative permittivity of th TN-mode liquid crystal.

As described above, the liquid crystal has a pixel capacitance CL. FIG. 9 shows the relationship between VLC and the relative permittivity εr of the capacitance CL of the liquid crystal of FIG. 8. As shown in FIG. 9, the relative permittivity εr varies depending on VLC, and εr becomes smaller with a lowering of VLC. Therefore, for example, the capacitance CL of the liquid crystal when VLC=V7 is smaller than that when VLC=V0. Thus, according to above equations (12) and (13), ΔV to be eliminated becomes larger.

Here, it is assumed that the average of the reference line drive voltages Vcom is set higher than the average of the signal line drive voltages (gray-scale voltages) only by an amount of ΔV0. In this case, if the signal line drive voltage is V0, the non-symmetry of the liquid crystal applied voltage is cancelled. However, in this state, if V7 is applied as the signal line drive voltage, since ΔV is larger than ΔV0, ΔV can not be sufficiently eliminated. In this embodiment, therefore, in order to sufficiently eliminate such a varying ΔV, the average of the signal line drive voltages is arranged to be lowered as the signal line drive voltage changes from V0 to V7, thereby increasing the difference between the average of the reference line drive voltages Vcom and the average of the signal line drive voltages so that the difference is always equal to the varying ΔV.

Besides, the reference line drive voltage Vcom is generated by the above-mentioned differential amplifier circuit 41 shown in FIG. 7, and the Class B amplifier 43 as a current amplifying section of this circuit is achieved by VampH, VampL, transistors Tr1, Tr2, and resistor R5. Here, as both of two voltage values that can be taken by each signal line drive voltage, only voltages of not less than 0 V are used to achieve a circuit for generating each signal line drive voltage by a simple structure.

Moreover, VcomL is a positive voltage of not less than 1 V. As a result, considering that VampL is set lower than VcomL by about 1 V or more, it is possible to select a voltage of not less than 0 V as VampL. Consequently, since a circuit that generates the reference line drive voltage can be realized only by a voltage of not less than 0 V without using a negative voltage, it is possible to achieve driving with a simple circuit structure and a smaller number of component parts. Here, VampL is set lower than VcomL by an amount of about 1 V or more. However, in any case, since it is certain that VampL is equal to VcomL or less, in order to select a voltage of not less than 0 V as VampL, VcomL must be at least a positive voltage.

Additionally, in this embodiment, the average of the reference line drive voltages Vcom is arranged to be higher than the average of the signal line drive voltage V0, i.e., a signal line drive voltage which takes a maximum value among the signal line drive voltages, by an amount of at least 1 V or more.

Figure 18:
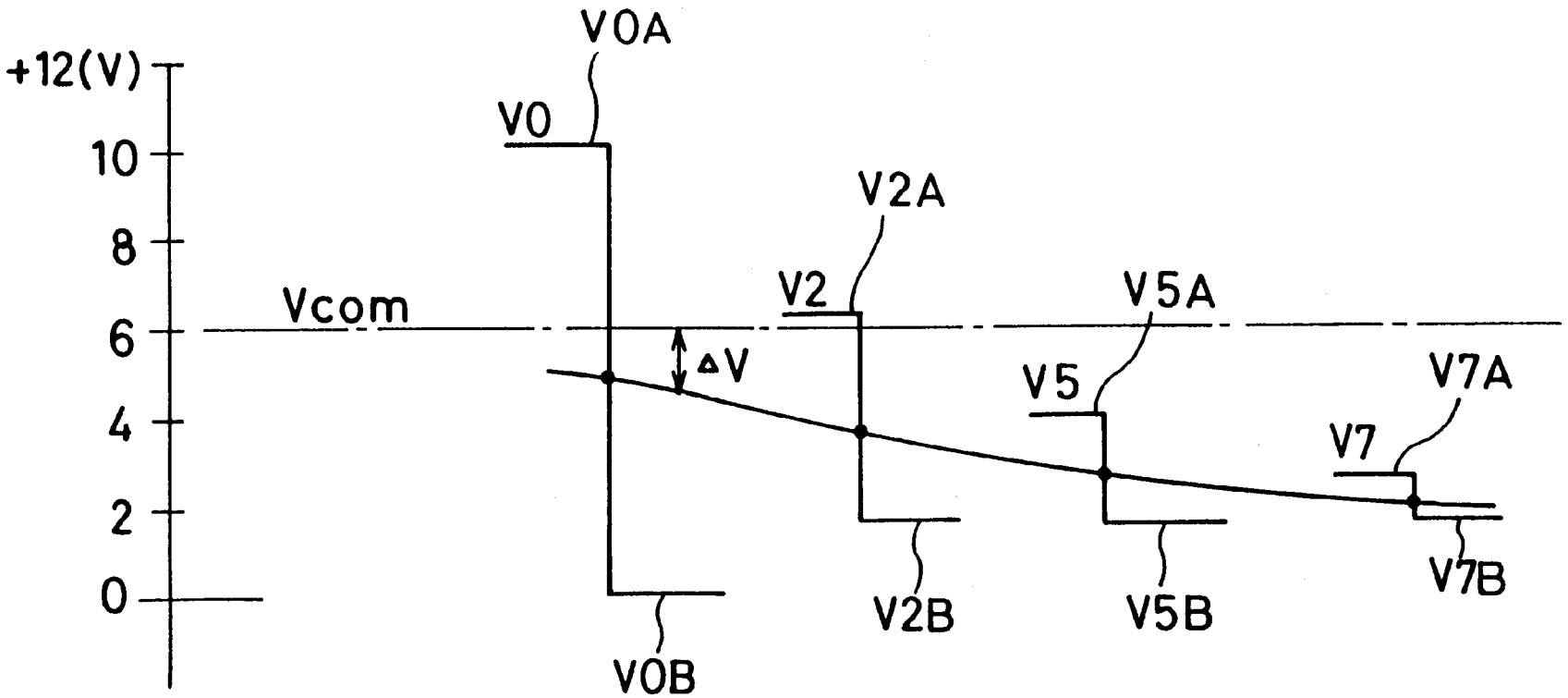
FIG. 18 is a graph showing the relationship between the reference line drive voltage and each gray-scale voltage when the reference line drive voltage is a DC voltage according to the method of driving a liquid crystal display device of the present invention.

Besides, in the method of driving a liquid crystal display device of the present invention, the reference line drive voltage may be a DC voltage. FIG. 18 shows the relationship between the reference line drive voltage Vcom as the DC voltage and four signal line drive voltages (V0, V2, V5 and V7) in respect of the phases and ΔV correspondingly to FIG. 1. In FIG. 18, the average of the signal line drive voltages of each gray scale is arranged to be lowered with an increase in the gray-scale number n, i.e., with a lowering of the liquid crystal applied voltage VLC. As a result, the difference (ΔV) between the average of the signal line drive voltages of each gray scale and the average of Vcom is increased. Namely, the basic relationship is the same as that shown in FIG. 1.

Figure 19:
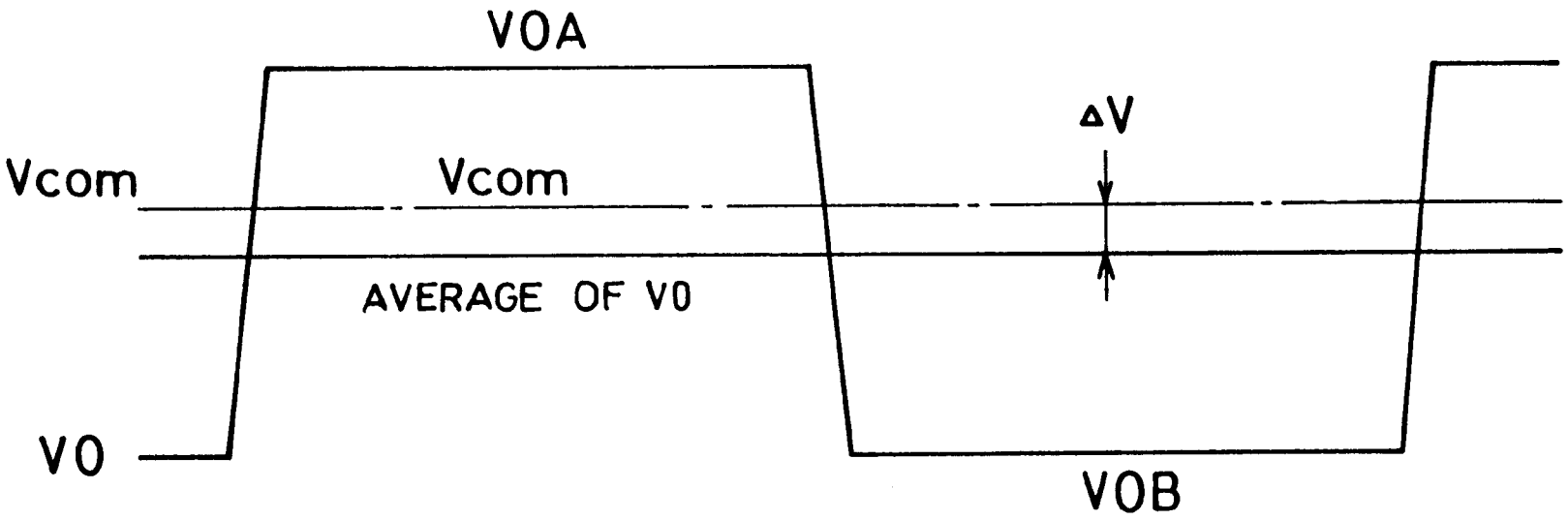
FIG. 19 is a graph showing the relationship between the reference line drive voltage and a maximum gray-scale voltage when the reference line drive voltage is a DC voltage according to the present invention.

Further, FIG. 19 shows the relationship corresponding to FIG. 2 when the reference line drive voltage is the DC voltage as mentioned above. The average of the reference line drive voltage Vcom is made higher than the average of the signal line drive voltage V0 by only an amount of ΔV. In short, the basic relationship is the same as that shown in FIG. 2. Here, when Vcom is the DC voltage, the average of Vcom is the value of the DC voltage, but the basic relationship between the average of the signal line drive voltage and the average of Vcom is the same irrespective of whether Vcom is a DC voltage or AC voltage.

[Embodiment 2]

Figure 10:
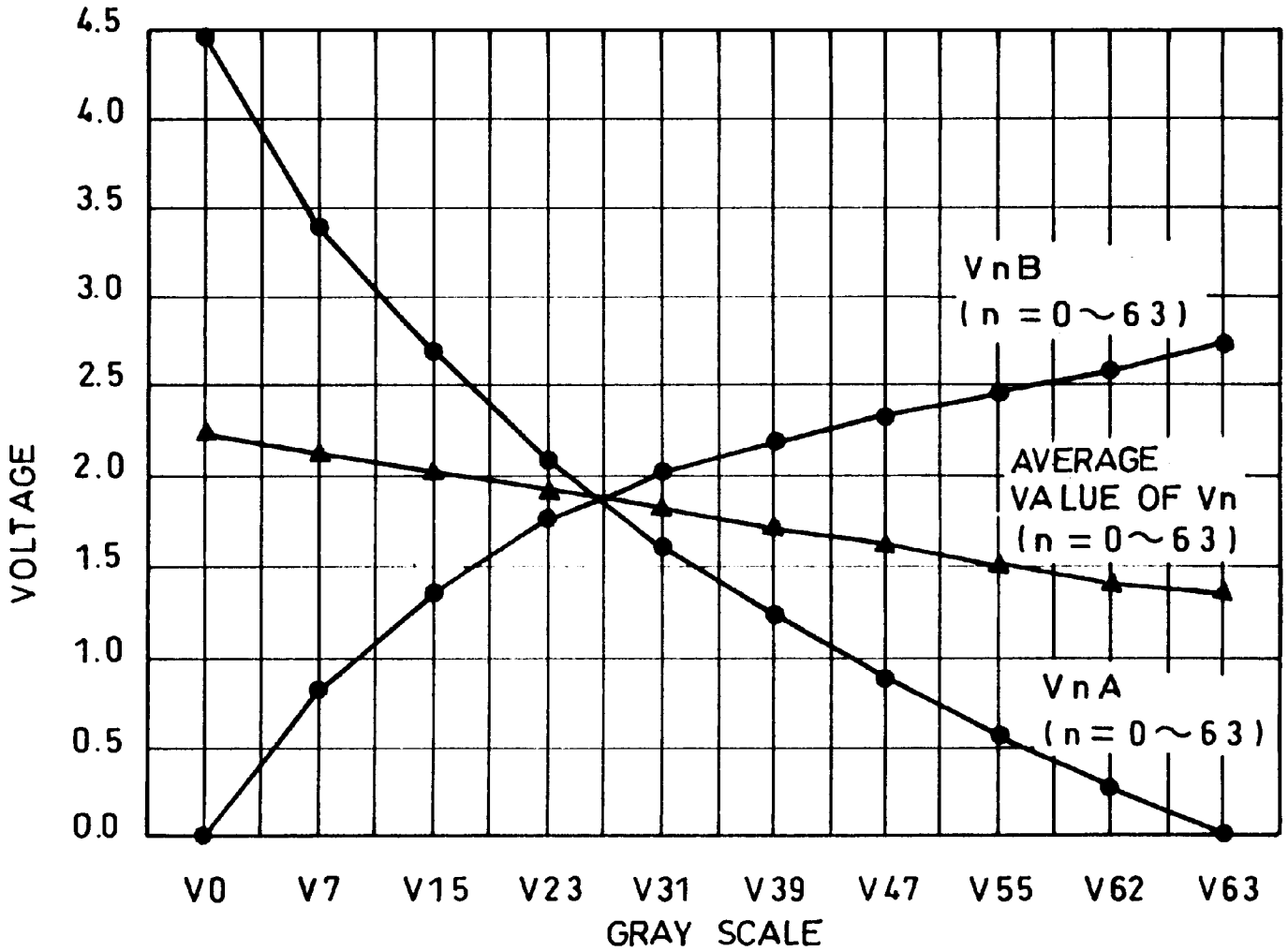
FIG. 10 is a graph showing the output voltage characteristics of the gray-scale voltage for each gray scale according to another example of the method of driving a liquid crystal display device of the present invention.
Figure 11:
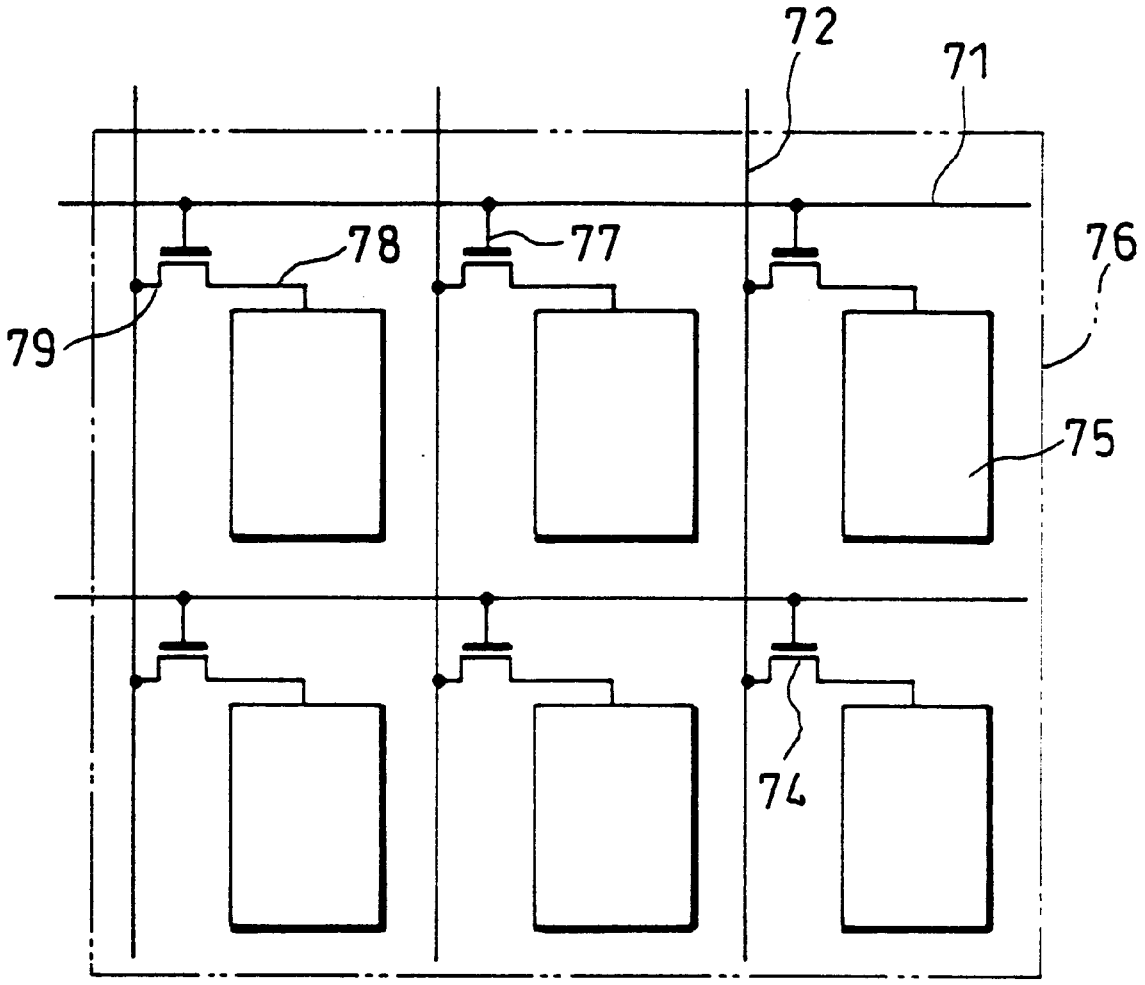
FIG. 11 is a plan view showing schematic structures of essential sections of a conventional liquid crystal display device.
Figure 12A:
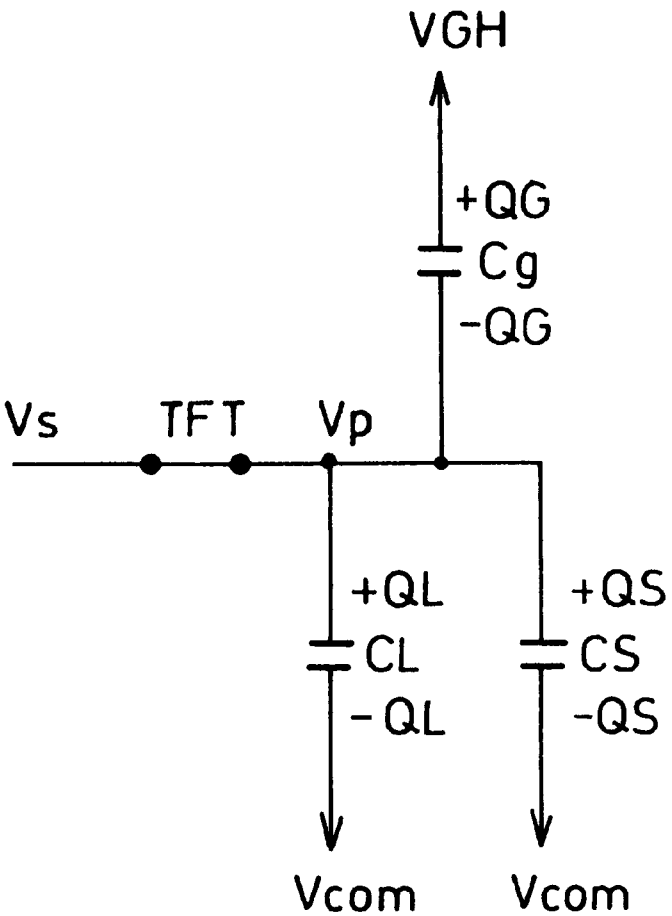
FIGS. 12(*a*) and 12(*b*) are circuit diagrams showing an equivalent circuit of a pixel section of the conventional liquid crystal display device.
Figure 12B:
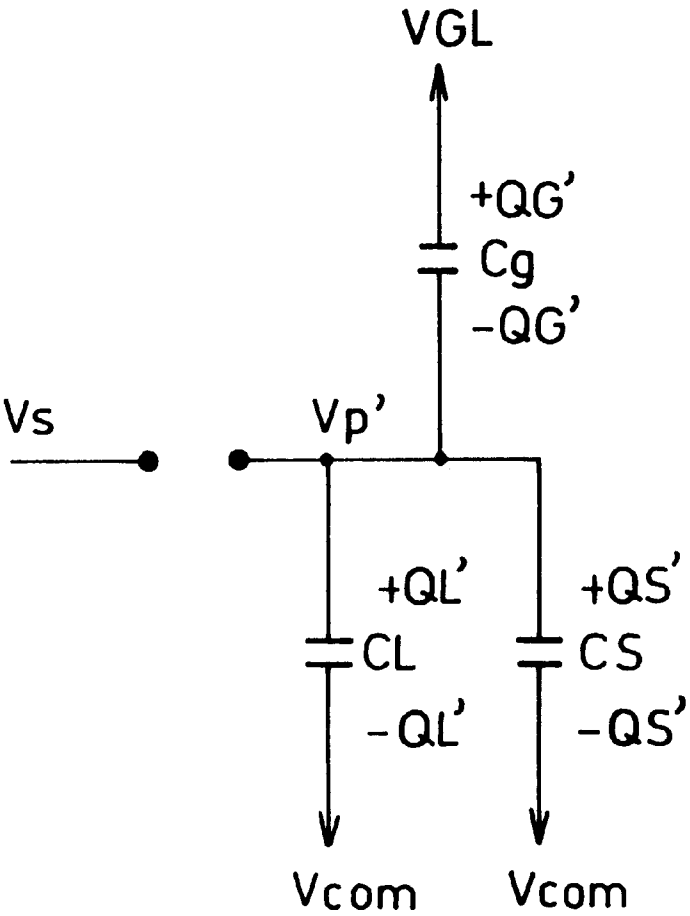
Figure 13:
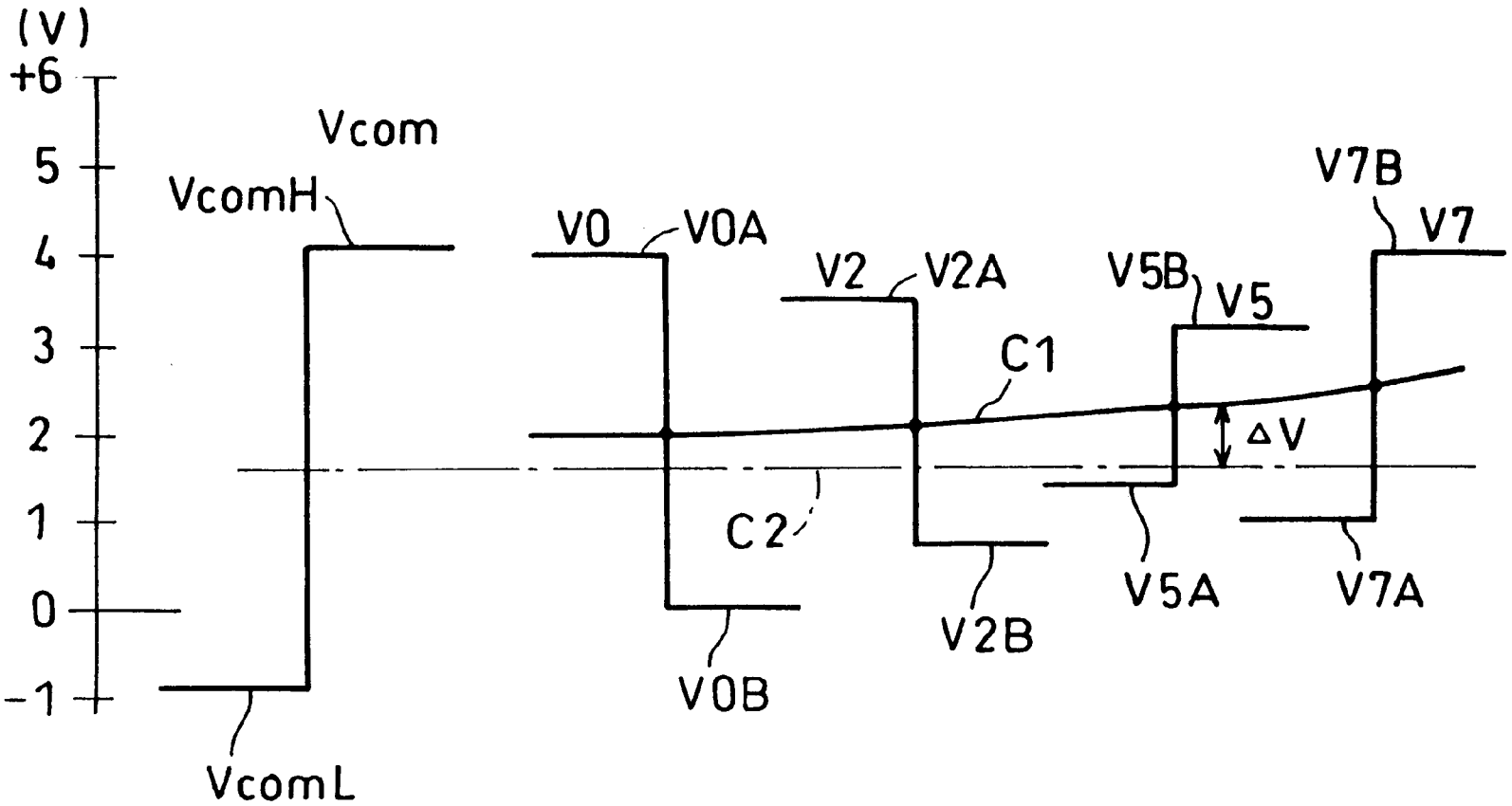
FIG. 13 is a graph showing the relationship between the common electrode drive voltage and each gray-scale voltage according to a method of driving the conventional liquid crystal display device.
Figure 14:
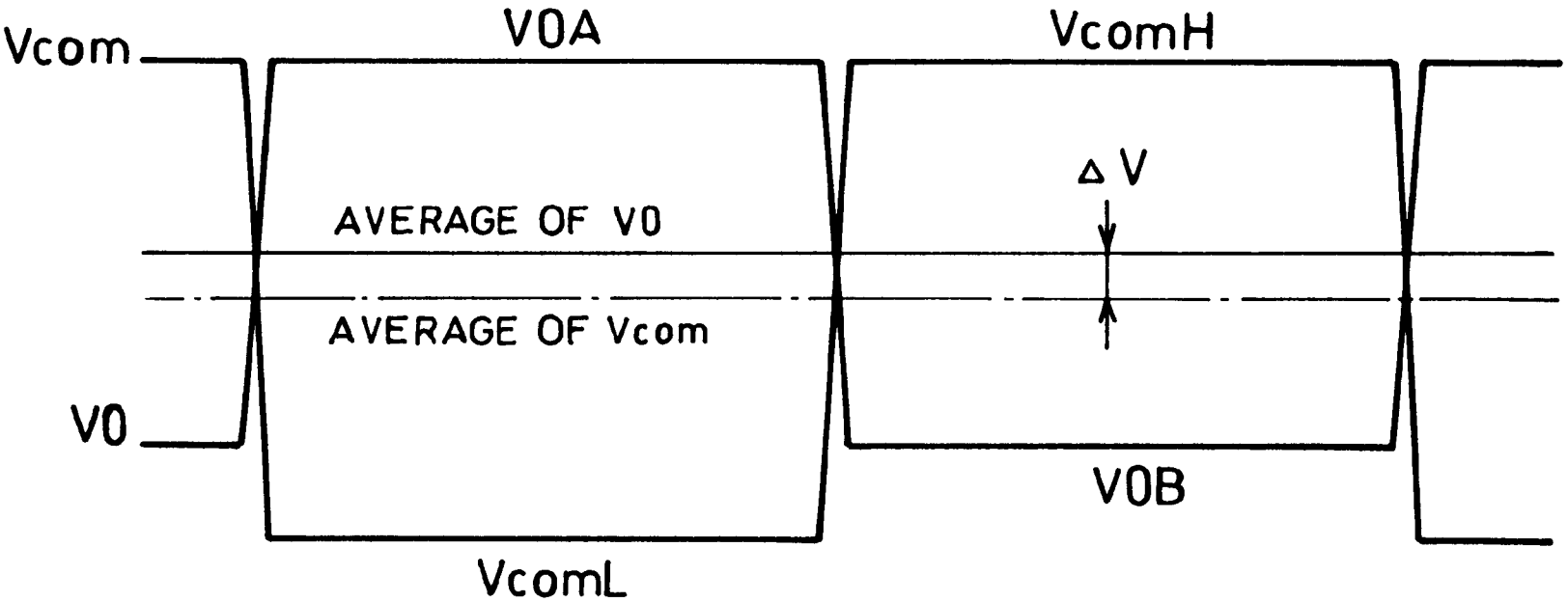
FIG. 14 is a graph showing the relationship between a conventional common voltage and a maximum gray-scale voltage applied to the liquid crystal.
Figure 15:
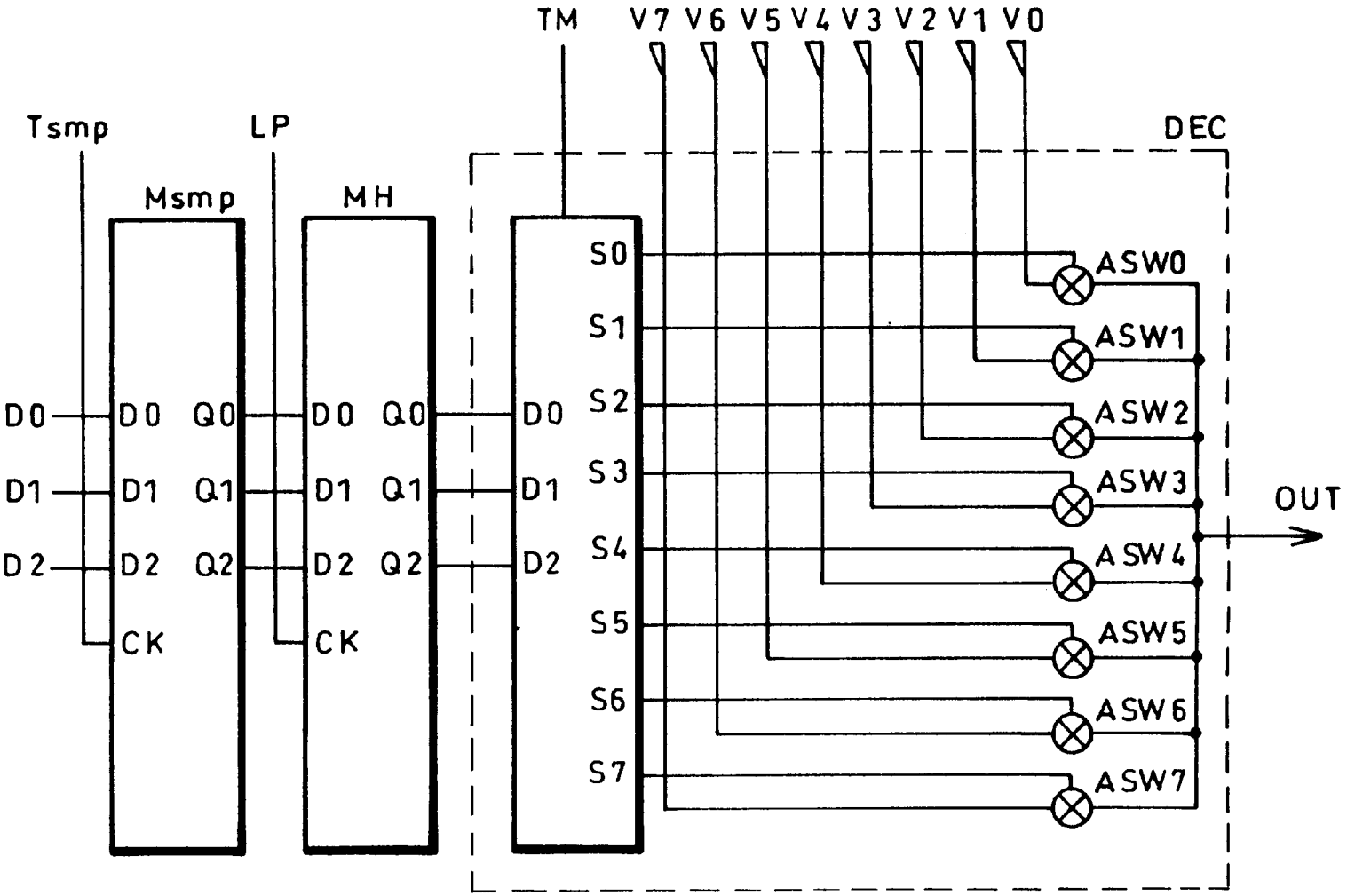
FIG. 15 is a block diagram showing a structure of a conventional data driver.
Figure 16:
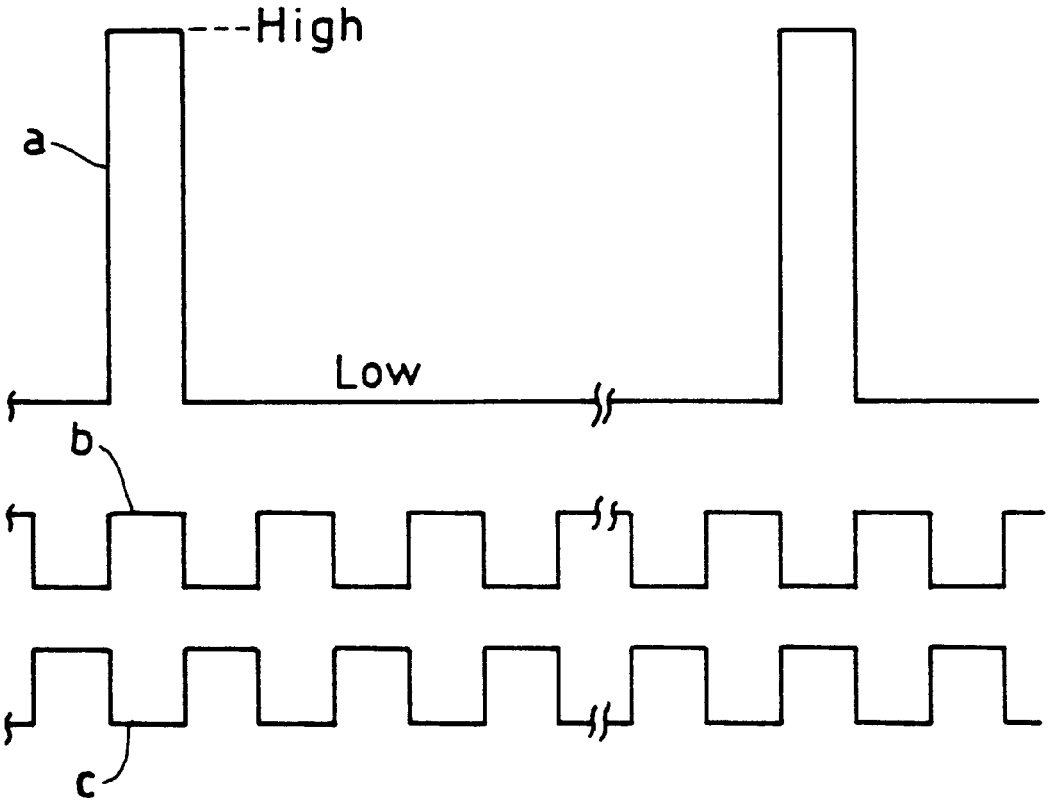
FIG. 16 is an explanatory view showing the waveforms of conventional scanning line drive voltage, gray-scale voltage, and reference line drive voltage.

Referring now to FIG. 10, the following description will explain another embodiment of the present invention.

In this embodiment, the drive circuit of the liquid crystal display device uses the drive method of the present invention to enable a display of 260,000colors with a 6-bit driver. The gray-scale voltages set by this drive method are shown in FIG. 10. Specifically, at V0, V7, V15, V23, V31, V39, V47, V55, V62 and V63, VnA (n=0 to 63), VnB (n=0 to 63), and the average ((VnA+VnB)/2) of Vn at each gray-scale voltage are shown.

In order to generate the gray-scale voltages, it is originally necessary to produce constant voltages of 128 gray scales that are two times of 64 gray scales. In actual fact, however, a total of 10 gray-scale voltages (a total of 20 constant voltages) V0A, V7A, V15A, V23A, V31A, V39A, V47A, V55A, V62A, V63A, and V0B, V7B, V15B, V23B, V31B, V39B, V47B, V55B, V62B, V63B are supplied to the data driver 27 (see FIG. 6). Besides, for a data signal between the gray scales, a desired gray-scale voltage is obtained by resistive division from two gray scales in the data driver 27, and output to the liquid crystal panel.

It should be understood from the above explanation, the method of driving a liquid crystal display device of the second embodiment may be designed in the same manner as the first embodiment as follows. Specifically, the method of driving a liquid crystal display device determines voltages with respect to the liquid crystal display device in which active three-terminal elements, scanning lines, reference lines and transparent pixel electrodes are arranged on a single substrate, each active three-terminal element having a gate electrode connected to the scanning line, a drain electrode connected to the pixel electrode, a source electrode connected to the reference line, signal lines made of transparent conductors are arranged on another substrate facing the above substrate, and an electric field is applied to a layer of liquid crystal between the another substrate and the pixel electrodes, so that the average voltage of reference line drive voltages for AC-driving the liquid crystal is higher than the average voltage of signal line drive voltages.

Moreover, the method of driving a liquid crystal display device of the second embodiment may be designed in the same manner as the first embodiment as follows. Specifically, when displaying a plurality of gray scales, the signal line drive voltages of each gray scale are determined so that the average voltage of the signal line drive voltage is decreased with a lowering of a voltage applied to the liquid crystal as an absolute value.

Furthermore, the method of driving a liquid crystal display device of the second embodiment may be designed in the same manner as the first embodiment as follows. Specifically, both of two voltage values that the reference line drive voltage can take are made positive values.

In addition, when displaying a plurality of gray scales, the method of driving a liquid crystal display device of the present invention may set the signal line drive voltages of each gray scale so that the average voltage of the signal line drive voltages is decreased with a reduction in the voltage difference applied to the liquid crystal as an absolute value.

With this structure, when displaying a plurality of gray scales, the signal line drive voltages of each gray scale are set so that the average voltage of the signal line drive voltages is decreased with a reduction in the voltage difference applied to the liquid crystal as an absolute value.

Therefore, the voltage difference applied to the liquid crystal as an absolute value, i.e., the difference between the average voltage of the signal line drive voltages and the average voltage of the reference line drive voltages, is appropriately set for each gray scale to compensate for the apparent non-symmetry of the transmissivity of the liquid crystal with respect to the positive and negative drive voltages. It is thus possible to achieve a high-quality image display for each gray scale by the method of driving a liquid crystal display device of the opposing signal line structure, in addition to the effects of the above-described structures.

Besides, in the method of driving a liquid crystal display device of the present invention, the reference line drive voltage may be an AC voltage.

According to this structure, the reference line drive voltage is an AC voltage. For example, the reference line drive voltage is driven by a binary rectangular wave.

Therefore, compared with a structure where the reference line drive voltage is a DC voltage, the amplitude by the positive and negative voltages of each signal line drive voltage with reference to the reference line drive voltage can be decreased. It is thus possible to provide a high-quality image display with a low-power-consuming liquid crystal display device, in addition to the effects of the above-described structure.

Further, in the method of driving a liquid crystal display device of the present invention, both of two voltage values of the reference line drive voltage may be positive values.

According to this structure, both of two voltage values of the reference line drive voltage are made positive values.

Therefore, a negative voltage is not necessary as a base voltage of the reference line drive voltage, and the reference line drive voltage can be generated only by positive voltages. Hence, a circuit for generating the reference line drive voltage can be achieved by a simple structure. It is thus possible to provide a high-quality image display with a low-power-consuming liquid crystal display device and a simple circuit structure including a small number of component parts, in addition to the effects of the above-described structures.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a liquid crystal display device, including a first substrate whereon an active three-terminal element having a gate electrode connected to a scanning line, a drain electrode connected to a pixel electrode and a source electrode connected to a reference line is arranged, a second substrate which faces said first substrate and has a signal line arranged thereon, and a layer of liquid crystal between said pixel electrode and said second substrate, by applying an electric field to said layer of liquid crystal, said method comprising the step of setting an average voltage of reference line drive voltages applied to said reference line for AC-driving the liquid crystal higher than an average voltage of signal line drive voltages; and wherein, in the step of setting the average voltage of the reference line drive voltages, the average voltage of the reference line drive voltages is set higher than the average voltage of the signal line drive voltage by an amount of reduction of an electric potential of said pixel electrode during a transition of the active three-terminal element arranged on said pixel electrode from an ON state to and OFF state.

2. The method of driving a liquid crystal display device as set forth in claim 1, wherein, in the step of setting the average voltage of the reference line drive voltages, the active three-terminal element is a TFT.

3. A method of driving a liquid crystal display device, including a first substrate whereon an active three-terminal element having a gate electrode connected to a scanning line, a drain electrode connected to a pixel electrode and a source electrode connected to a reference line is arranged, a second substrate which faces said first substrate and has a signal line arranged thereon, and a layer of liquid crystal between said pixel electrode and said second substrate, by applying an electric field to said layer of liquid crystal, said method comprising the step of setting an average voltage of reference line drive voltages applied to said reference line for AC-driving the liquid crystal higher than an average voltage of signal line drive voltages; and wherein, when displaying a plurality of gray scales, in the step of setting the average voltage of the reference line drive voltage, the signal line drive voltage of each gray scale is set so that the average voltage of the signal line drive voltages is lowered with the decrease in a voltage difference applied to liquid crystal as an absolute value.

4. The method of driving a liquid crystal display device as set forth in claim 3, wherein, in the step of setting the average voltage of the reference line drive voltages, for each gray scale, the average voltage of the reference line drive voltages is set higher than the average voltage of the signal line drive voltage by an amount of reduction of an electric potential of said pixel electrode during a transition of the active three-terminal element arranged on said pixel electrode from an ON state to an OFF state.

5. The method of driving a liquid crystal display device as set forth in claim 4, wherein, in the step of setting the average voltage of the reference line drive voltages, the liquid crystal is of a twisted nematic mode.

6. A method of driving a liquid crystal display device, including a first substrate whereon an active three-terminal element having a gate electrode connected to a scanning line, a drain electrode connected to a pixel electrode and a source electrode connected to a reference line is arranged, a second substrate which faces said first substrate and has a signal line arranged thereon, and a layer of liquid crystal between said pixel electrode and said second substrate, by applying an electric field to said layer of liquid crystal, said method comprising the steps of:

setting an average voltage of reference line drive voltages applied to said reference line for AC-driving the liquid crystal higher than an average voltage of signal line drive voltages; and generating the reference line drive voltage by synthesizing an intermediate voltage from one of the signal line drive voltages and constant voltage Vref and amplifying the intermediate voltage at a predetermined voltage Vamp.

7. The method of driving a liquid crystal display device as set forth in claim 6, wherein, in the step of generating the reference line drive voltage, a voltage V0 which causes a liquid crystal applied voltage which is a voltage applied to the liquid crystal to be maximum is used as the signal line drive voltage for the synthesis.

8. The method of driving a liquid crystal display device as set forth in claim 6, wherein, in the step of generating the reference line drive voltage, the voltage Vamp has only a positive value.

9. The method of driving a liquid crystal display device as set forth in claim 8, wherein, in the step of generating the reference line drive voltage, the voltage Vamp takes only two values VampH and VampL smaller than the value VampH, and the value VampL is a positive value.

10. The method of driving a liquid crystal display device as set forth in claim 9, wherein, in the step of generating the reference line drive voltage, the value VampL is set lower than a minimum value of the reference line drive voltage by an amount of 1 V or more.

11. The method of driving a liquid crystal display device as set forth in claim 9, wherein, in the step of generating the reference line drive voltage, the value VampH is set higher than a maximum value of the reference line drive voltage by an amount of 1 V or more.

12. The method of driving a liquid crystal display device as set forth in claim 6, wherein, in the step of generating the reference line drive voltage, the reference line drive voltage is not less than 1 V.

13. The method of driving a liquid crystal display device as set forth in claim 12, wherein, in the step of generating the reference line drive voltage, the reference line drive voltage takes only two values VcomH and VcomL smaller than the value VcomH, and the value VcomL is not less than 1 V.

* * * * *